US006681708B2

(12) United States Patent
Gokan

(10) Patent No.: US 6,681,708 B2
(45) Date of Patent: Jan. 27, 2004

(54) ENGINE FOR PLANING BOAT

(75) Inventor: Yoshitsugu Gokan, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/193,115

(22) Filed: Jul. 12, 2002

(65) Prior Publication Data

US 2003/0015127 A1 Jan. 23, 2003

(30) Foreign Application Priority Data

Jul. 19, 2001 (JP) ..... 2001-219320

(51) Int. Cl.[7] ..... B63B 35/73

(52) U.S. Cl. ..... 114/55.5; 74/603; 74/604; 123/192.2; 440/52

(58) Field of Search ..... 440/52, 83; 114/55.5; 123/192.2, 199 P; 74/603, 604

(56) References Cited

U.S. PATENT DOCUMENTS 3,401,579 A * 9/1968 Derrig ..... 74/604
3,511,110 A * 5/1970 Grieve ..... 74/604
4,572,025 A * 2/1986 Mitchell ..... 74/604
5,065,644 A * 11/1991 Shimada ..... 74/603
5,884,599 A * 3/1999 Shiozaki et al. ..... 123/192.2
5,960,761 A * 10/1999 Kawakubo et al. ..... 123/192.2

* cited by examiner

*Primary Examiner*—S. Joseph Morano
*Assistant Examiner*—Lars A. Olson
(74) *Attorney, Agent, or Firm*—Birch, Stewart, Kolasch & Birch, LLP

(57) ABSTRACT

An engine suitable for mounting in a small planing boat, which both lowers the center of the gravity of the boat, and enables a degree of freedom in arranging accessories. Balancers are arranged on the left and on the right of a crankshaft on a parting face of an engine. The engine is mounted in the body of the small planing boat surrounded by a hull and a deck. A starter motor and an idle gear of one balancer are arranged on the side opposite the starter motor, with the crankshaft between them. Also disposed between the idle gear and the starter motor is a cylinder. An oil tank is provided at the front of the engine, and two oil supply passages leading to the balancer supports are formed in the case of the oil tank.

14 Claims, 20 Drawing Sheets

FIG. 10(a)
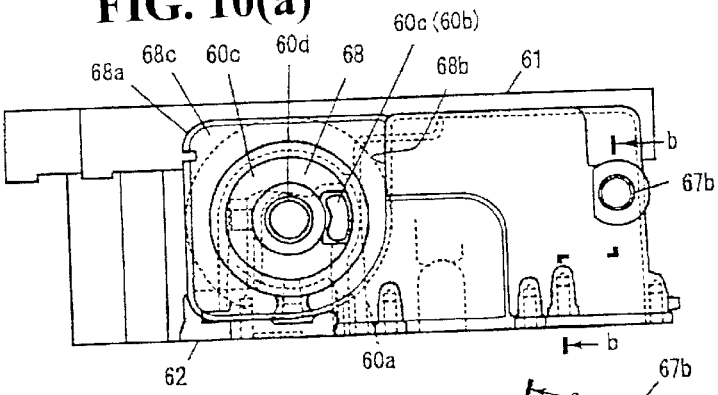
FIG. 10(d)
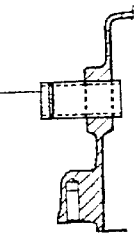
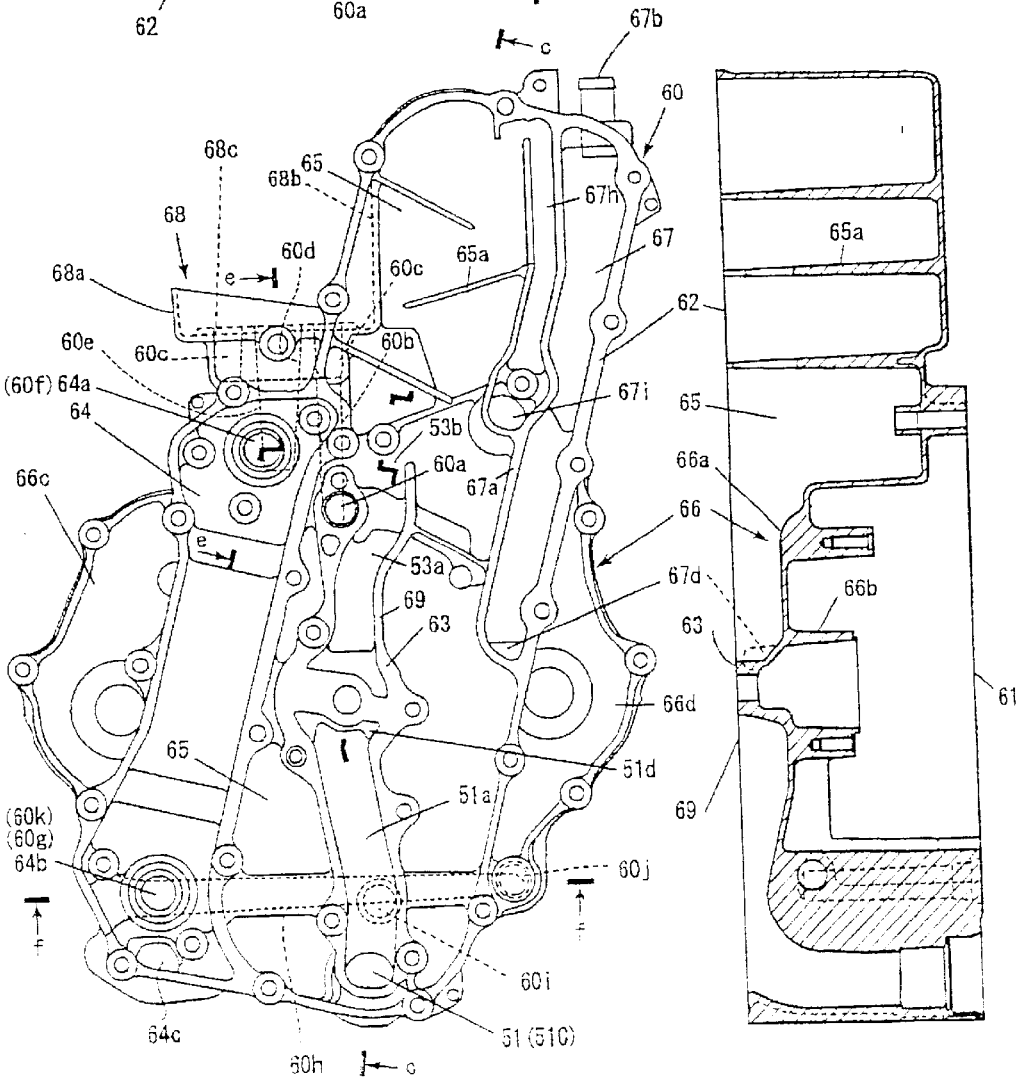
FIG. 10(b)
FIG. 10(c)

FIG. 12(a)
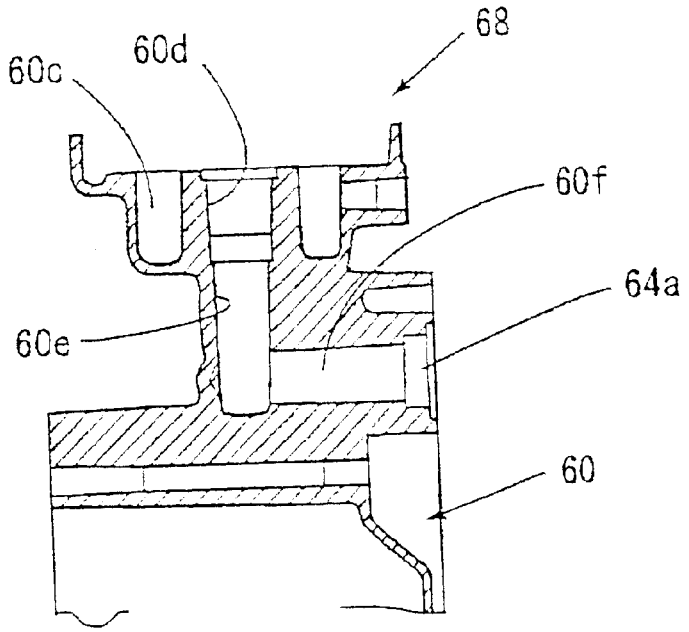
(f)
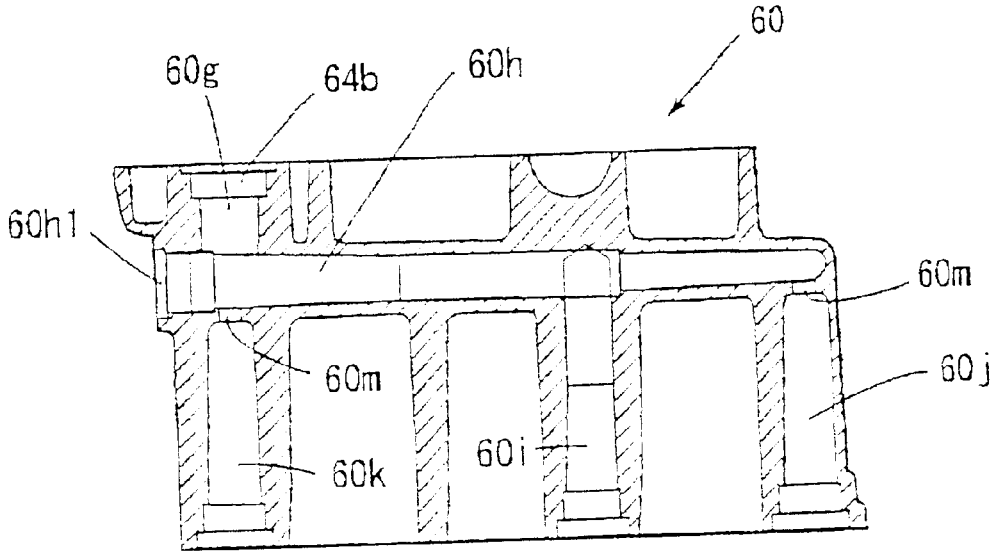
FIG. 12(b)

FIG. 13(b)
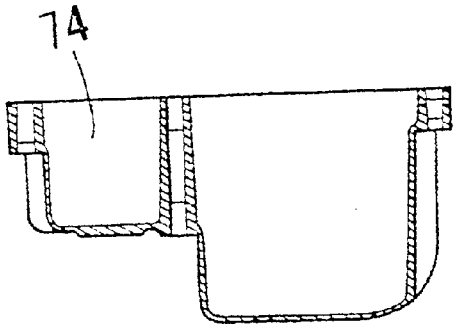
FIG. 13(d)
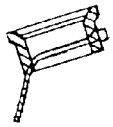
FIG. 13(c)
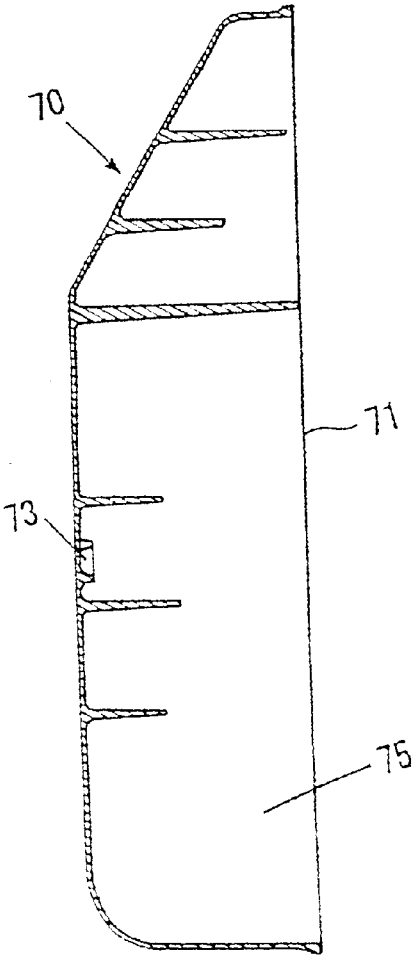
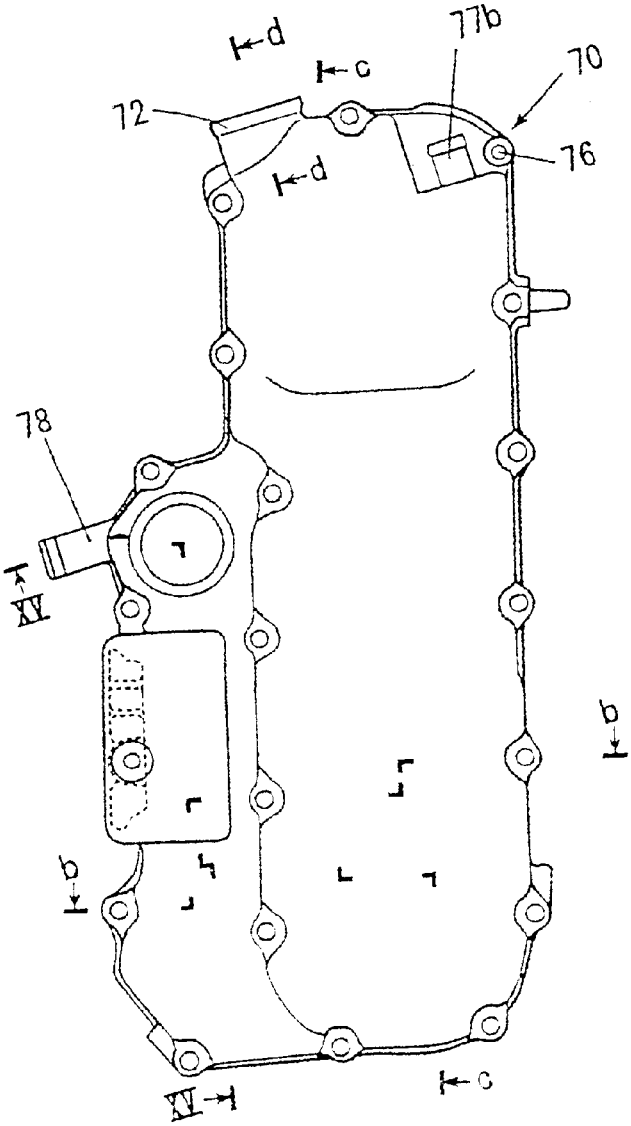
FIG. 13(a)

FIG. 17(a)
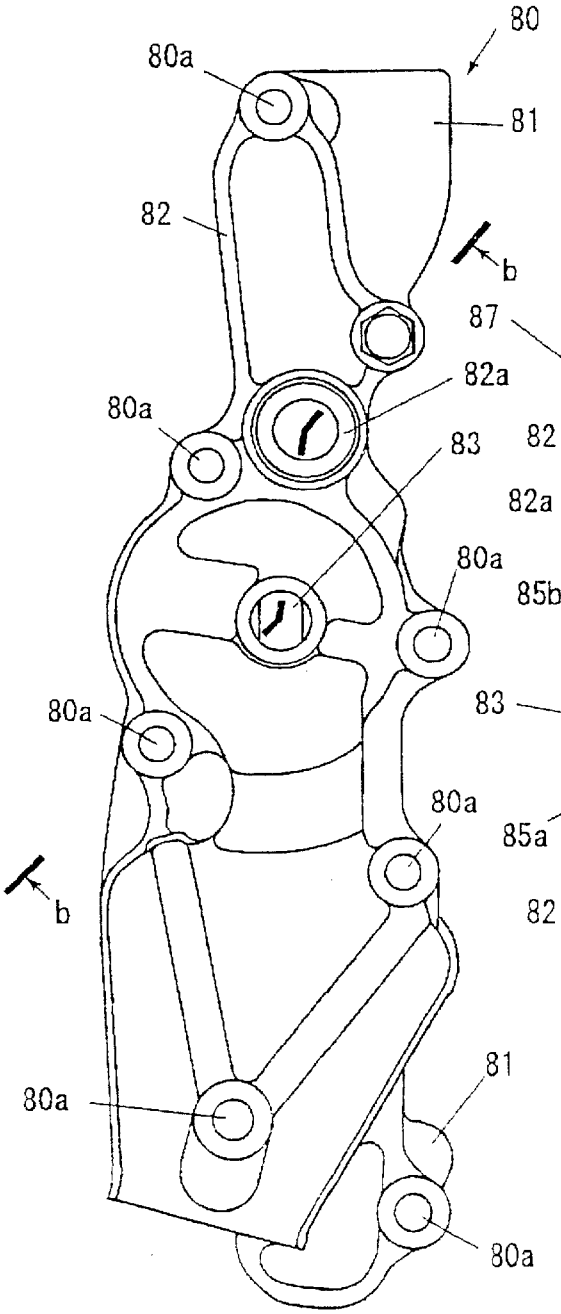
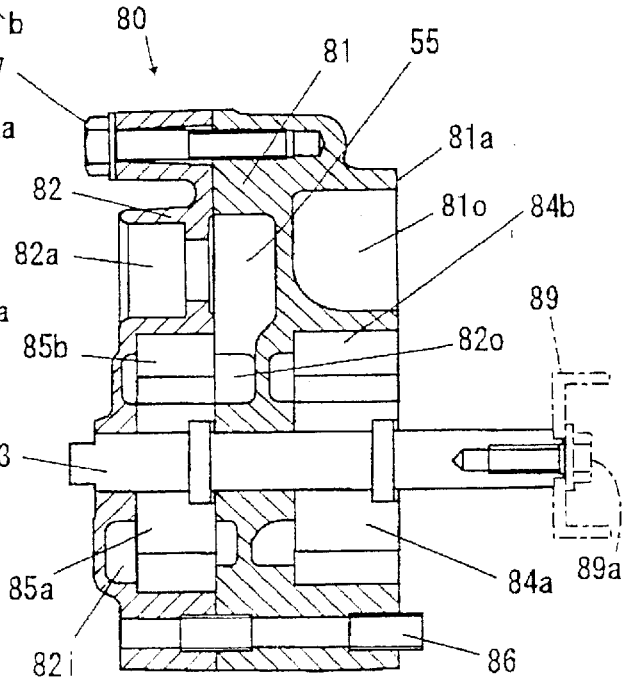
FIG. 17(b)

ENGINE FOR PLANING BOAT

CROSS-REFERENCE TO RELATED APPLICATION

The present application claims priority under 35 U.S.C. §119 to Japanese Patent Application No. 2001-219320, filed Jul. 19, 2001, the entire contents of which are hereby incorporated by reference.

BACKGROUND OF THE INVENTION

1. Field of the Invention

The present invention relates to the arrangement of a balancer of an engine for a planing boat, and more particularly to the arrangement of a balancer for a small-sized planing boat.

2. Description of Background Art

Several types of engines with balancers are known. They include an engine provided with balancers (so-called "biaxial balancers") which rotate in reverse directions, an engine with balancers arranged under a crankshaft, and an engine with balancers arranged on both sides of a cylinder-over a crankshaft.

When balancers are arranged under the crankshaft, the engine height is high, and tile engine is not suited for mounting in a small-sized planing boat. This configuration also presents a problem in that the center of the gravity is high. Furthermore, the position of the crankshaft is relatively high, because the balancers are arranged under the crankshaft. As a result, is difficult to couple the shaft of a jet propulsion pump on a line extending from the crankshaft.

Similarly, in an engine with balancers arranged on both sides of the cylinder over the crankshaft, the degree of freedom in arranging accessories is limited.

SUMMARY AND OBJECTS OF THE INVENTION

It is an object of the present invention is to solve these problems by providing an engine having a balancer suitable for mounting in a small-sized planing boat, while at the same time maintaining a low center of gravity of the boat and allowing a greater degree of freedom in the placement of boat accessories.

To achieve the objects, the engine of the present invention is mounted in the boat surrounded by the hull and the deck. The engine includes an upper case and a lower case, respectively divided on a parting face parallel to the crankshaft, and a balancer arranged on the left and on the right of the crankshaft on the parting face.

A balancer driving gear is provided at the periphery of a one-way clutch for starting the engine, the clutch being located at the back of an ACG rotor disposed at the end of the crankshaft.

An oil tank is provided at the front of the engine in the direction of an extended line from the crankshaft, and an oil supply passage to a balancer support is formed in an oil tank case. Further, a restrictor is provided in the oil supply passage. In addition, the oil tank covers a chamber for driving the ACG rotor, the balancer, and the starter motor.

Another aspect of the present invention includes arranging the starter motor of the engine and the balancer in parallel, and arranging the idle gear of one balancer on the side opposite to the starter motor, with the crankshaft between them. Further, the starter motor of the engine and the balancer are arranged in parallel, and the idle gear of one balancer is arranged on the side opposite to the starter motor, with the cylinder of the engine between them.

The actions and effects of the present invention are summarized below.

Since the engine for the small-sized planing boat is provided with the upper case and the lower case, respectively divided on the parting face parallel to the crankshaft, and the balancer is arranged on the left and on the right of the crankshaft on the parting face, the overall height of the engine can be reduced.

Therefore, the engine is suitable for mounting in the small-sized planing boat having only small space in the body. Simultaneously, the center of the gravity of the boat can be lowered.

Also, the position of the crankshaft can be lowered, with the result that the balancer is arranged on the left and on the right of the crankshaft on the face for parting the upper case and the lower case divided on the parting face parallel to the crankshaft. Further, the shaft of the jet propulsion pump can be coupled on the extended line of the crankshaft.

Furthermore, since the balancer is arranged on the left and on the right of the crankshaft on the parting face, a degree of freedom of arranging accessories can be achieved. As such, the engine is suitable for mounting in a small-sized planing boat, and simultaneously, the center of the gravity of the boat can be lowered.

In addition, even though the oil pan under the engine is small-sized, the agitation of oil by the balancer can be inhibited, compared with the conventional engine having the balancer provided under the crankshaft. Since the oil pan is small, the overall height of the engine can be lowered further.

Since the balancer driving gear is provided close to the back of the ACG rotor, which is disposed at the end of the crankshaft, a driving system of the balancer can be miniaturized, and the overall length of the engine can be reduced.

Since the one-way clutch for starting the engine is provided at the back of the ACG rotor, and the balancer driving gear is provided to the periphery of the one-way clutch, the overall length of the engine can be further reduced by the amount by which the one-way clutch of a starting system and the balancer driving gear overlap.

Since the oil tank is provided at the front of the engine in the direction of the extended line from the crankshaft and the oil supply passage to the balancer support is formed in the case of the oil tank, the whole engine can be reduced in size, and piping for the oil supply passage to the balancer support is not required.

Since a restrictor is provided in the oil supply passage, air is easily separated by the restrictor even if the air is mixed into the oil as it passes toward the balancer support. Therefore, lubrication of the balancer shaft is adequately provided.

Since the oil tank covers the chamber for driving the ACG rotor, the balancer and the starter motor, a separate cover is not required, and the overall length of the engine can be further reduced. In addition, noise can be reduced by the sound absorption effects of oil in the oil tank.

Since the starter motor of the engine and the balancer are arranged in parallel and the idle gear of one balancer is arranged on the side opposite to the starter motor with the crankshaft between them, the starter motor and the balancer driving system can be arranged compactly around the crankshaft. As a result, the center of the gravity of the engine can be lowered, and the center of the gravity of the whole boat can also be lowered.

Since the starter motor of the engine and the balancer are arranged in parallel and the idle gear of one balancer is arranged on the side reverse to the starter motor with the cylinder of the engine between them, the starter motor and the balancer driving system can be arranged compactly near the longitudinal axis of the engine. Therefore, the weight of the engine, including the starter motor and the driving system, can be centralized near the center of the boat, and the turning performance of the boat can be enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 10 show the body of a tank 60, FIG. 10(*a*) is a plan, FIG. 10(*b*) is a front view, FIG. 10(*c*) is a sectional view viewed along a line c—c in FIG. 10(*b*) and FIG. 10(*d*) is a sectional view viewed along a line d—d in FIG. 10(*a*);

FIG. 12(*a*) is a sectional view viewed along a line e—e in FIG. 10(*b*) and FIG. 12(*b*) is a sectional view viewed along a line f—f in FIG. 10(*b*);

FIG. 13 show a cover, FIG. 13(*a*) is a front view, FIG. 13(*b*) is a sectional view viewed along a line b—b in FIG. 13(*a*), FIG. 13(*c*) is a sectional view viewed along a line c—c in FIG. 13(*a*) and FIG. 13(*d*) is a sectional view viewed along a line d—d in FIG. 13(*a*);

FIG. 17 show an oil pump 80, FIG. 17(*a*) is a front view and FIG. 17(*b*) is a view viewed along a line b—b in FIG. 17(*a*);

FIG. 20 are explanatory drawings for explaining the return of oil when the upset boat 10 is restored in a normal position)

DETAILED DESCRIPTION OF THE PREFERRED EMBODIMENTS

Figure 1:
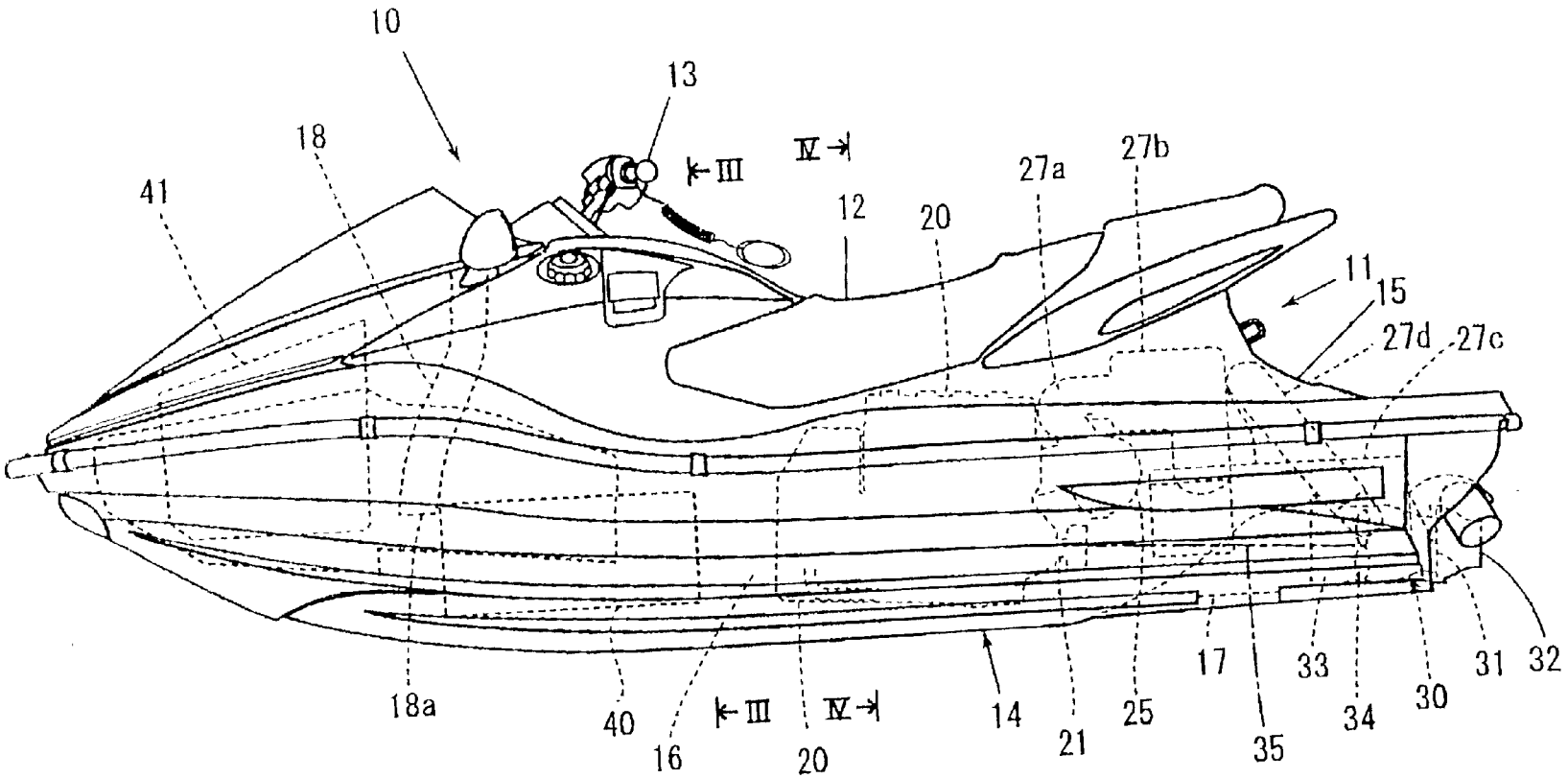
FIG. 1 is a schematic side view showing one example of a small-sized planing boat using one embodiment of an engine for a small-sized planing boat according to the present invention.

Referring to the drawings, an embodiment of the invention will be described below.

As shown in FIG. 1, the small-sized planing boat 10 is a saddle-type small-sized boat, a rider rides on a seat 12 on a body 11, and can operate the boat with a steering handlebar 13 provided with a throttle lever.

The body 11 has a floating structure in which a hull 14 and a deck 15 are bonded and between which a space 16 is formed. In the space 16, an engine 20 is mounted on the hull 14 and a jet pump (a jet propulsion pump) 30 as propelling means driven by the engine 20 is provided to the rear of the hull 14.

The jet pump 30 has a channel 33 from a water intake 17 opened in the boat bottom a jet port 31, and a nozzle 32 opened at the rear end of the body, and an impeller 34 arranged in the channel 33. A shaft 35 of the impeller 34 is coupled to an output shaft 21 of the engine 20. When the engine 20 rotatably drives the impeller 34, water admitted from the water intake 17 is jetted from the jet port 31 through the nozzle 32, so that the body 11 is propulsive. The driving rotation speed of the engine 20, that is, the propulsion of the jet pump 30 is operated by rotating operation of a throttle lever 13(*a*) (see FIG. 2) of the steering handlebar 13. The nozzle 32 is linked to the steering handlebar 13 by an operation wire, not shown, and is rotated by operation of the handlebar 13, thereby changing a course. Also shown, and is fuel tank 40 and housing chamber 41.

Figure 4:
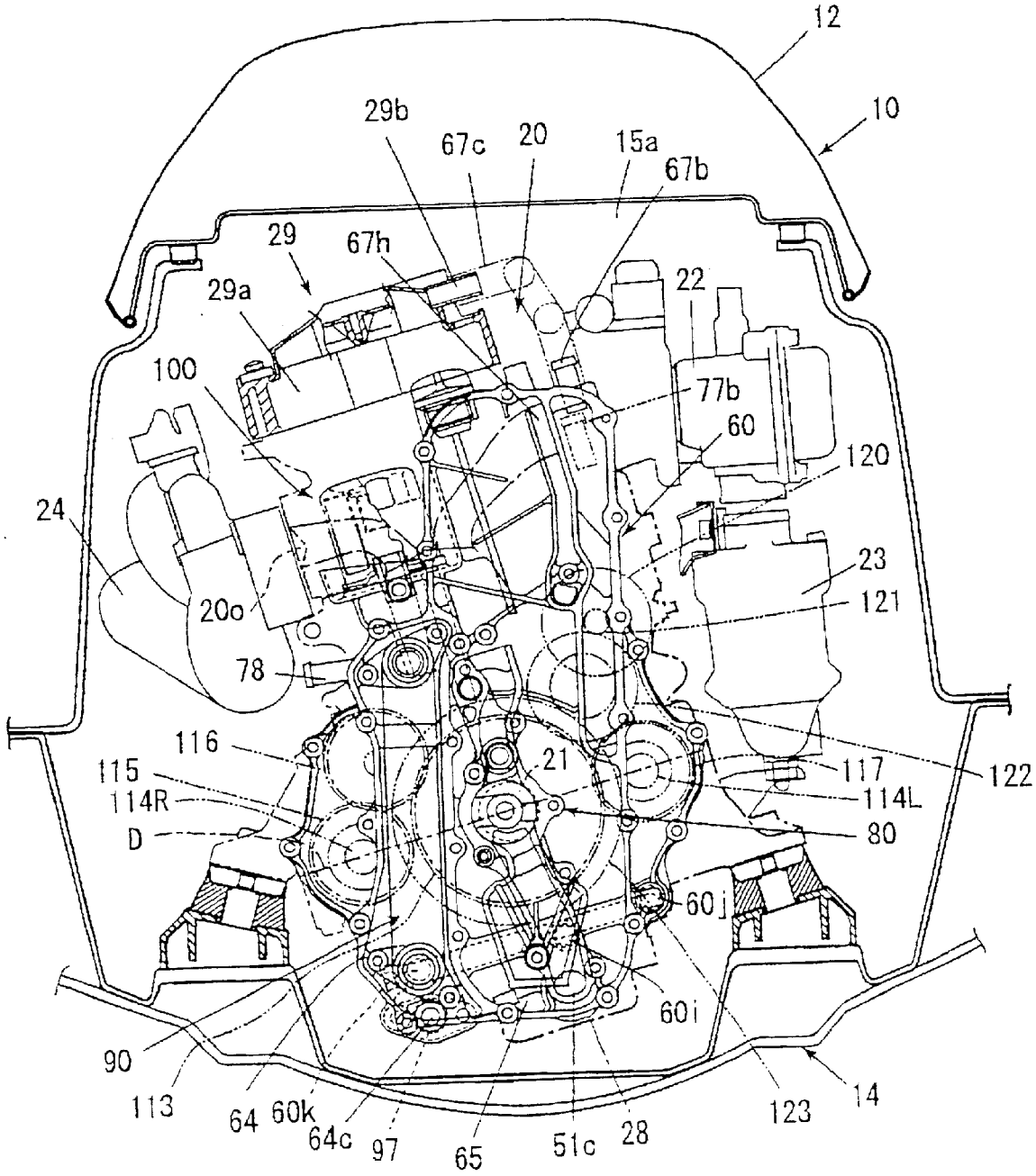
FIG. 4 mainly shows an engine 20 and is an enlarged sectional view viewed along a line IV—IV in FIG. I (a partially omitted sectional view)
Figure 5:
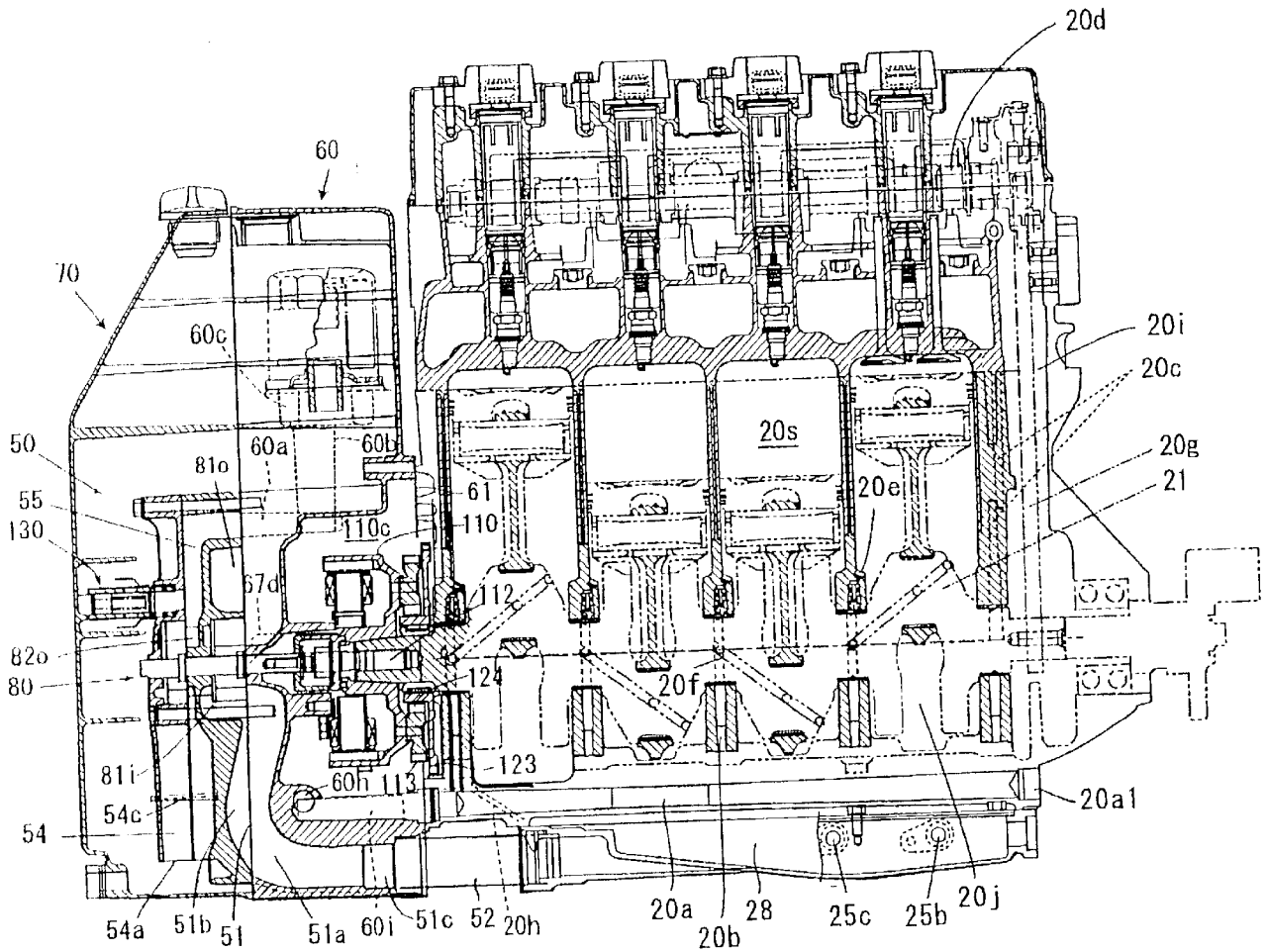
FIG. 5 is a right side view showing the engine 20.

FIG. 4 shows the engine 20, and is an enlarged sectional view showing a part viewed along a line IV—IV in FIG. 1 (a partial omitted sectional view). FIG. 5 is a right side view of the engine 20, FIG. 6 is a left side view, FIG. 7 is a schematic perspective view of the engine 20 viewed obliquely from behind, and FIG. 8 is a partially enlarged view of FIG. 5.

The engine 20 is a double over head cam shaft (DOHC)-type in-line four-cylilider dry sump four-cycle engine. As shown in FIGS. 1 and 5, its crankshaft 21 is arranged in the longitudinal direction of the body 11.

Figure 6:
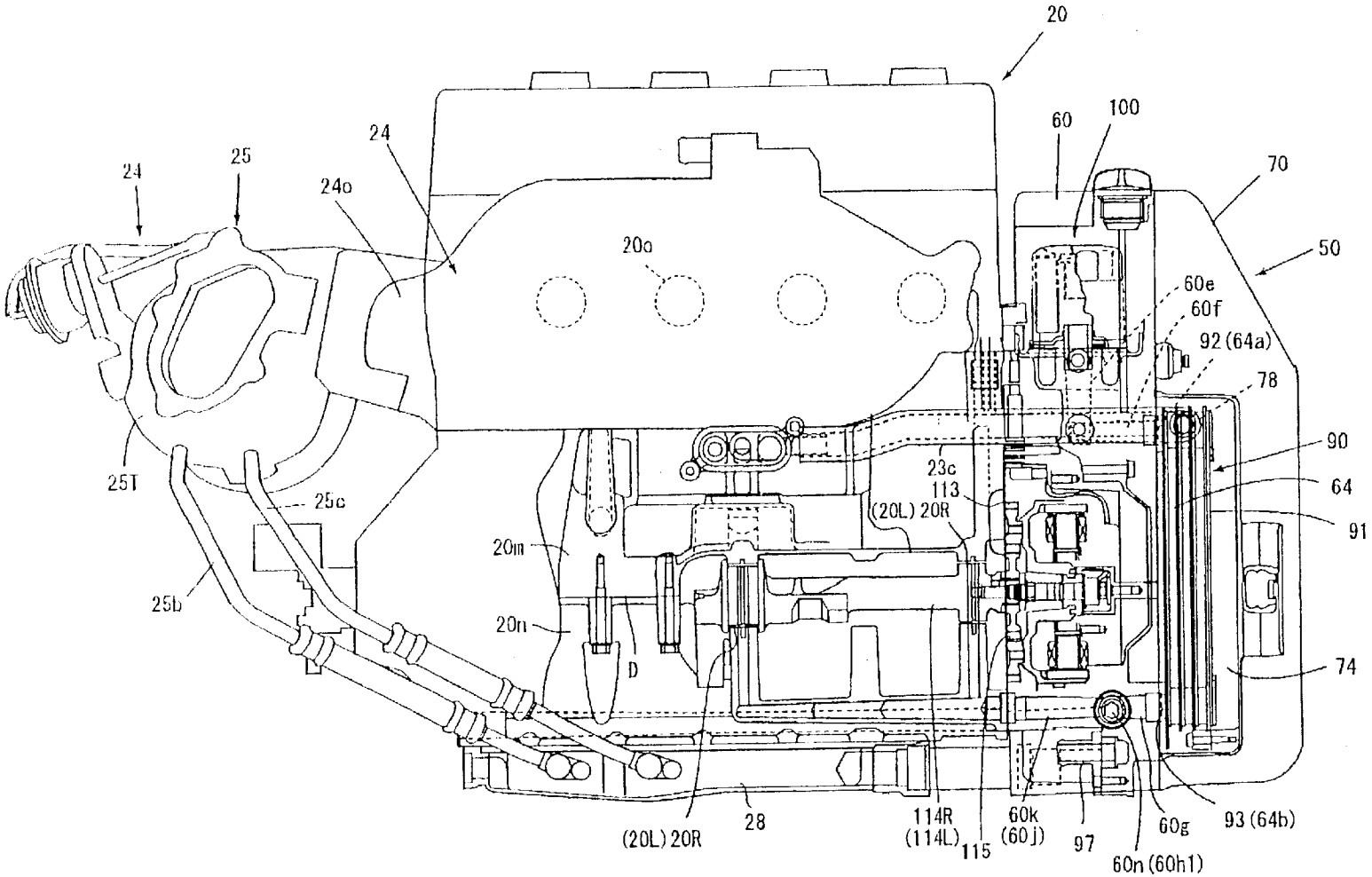
FIG. 6 is a left side view showing the engine 20.
Figure 7:
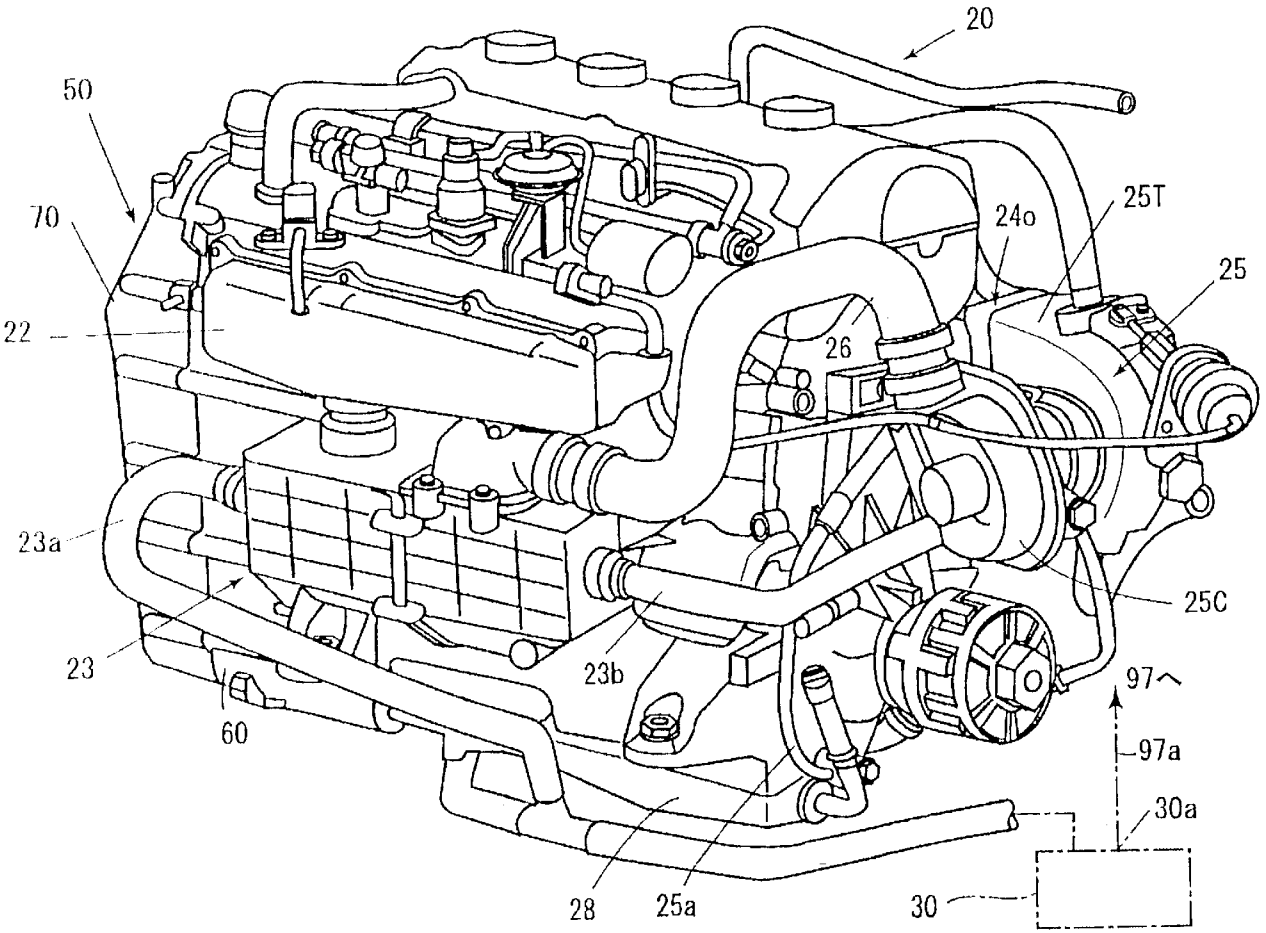
FIG. 7 is a schematic perspective view showing the engine 20 viewed from the diagonal rear.
Figure 8:
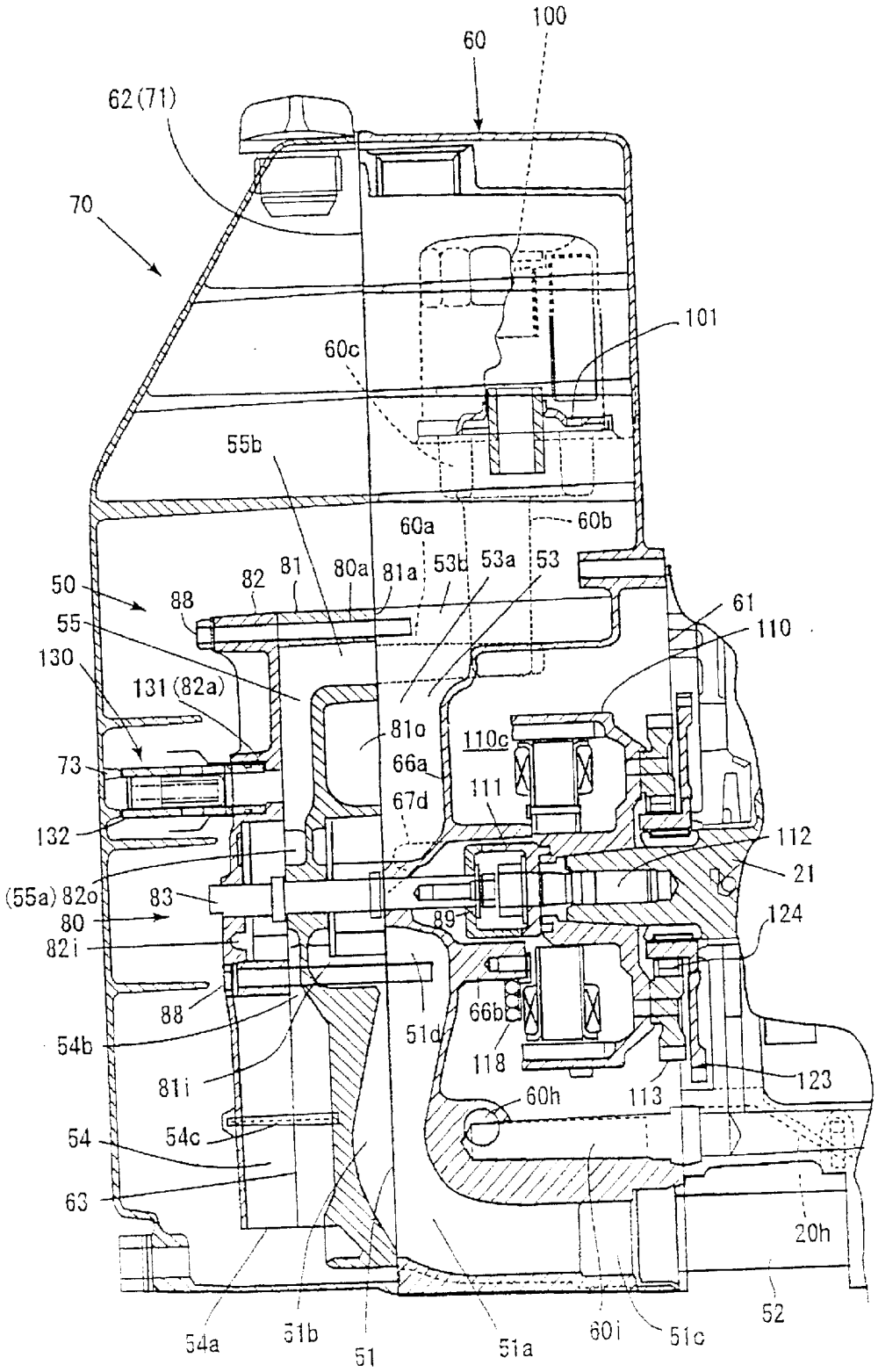
FIG. 8 is a partially enlarged view of FIG. 5.

As shown in FIGS. 4 and 7, a Surge tank (an intake chamber) 22 communicating with an intake port, and an inter-cooler 23 are connected to the left side of the engine 20 in a traveling direction of the body 11. An exhaust manifold 24, shown in FIG. 6 and communicating with an exhaust port 20*o*, is connected to the right side of the engine 20.

As shown in FIGS. 6 and 7, a turbo charger 25 is arranged at the rear of the engine 20. An exhaust outlet 24*o* of the exhaust manifold 24 is connected to a turbine 25T of the turborcharger 25, and the inter-cooler 23 is connected to its compressor 25C via piping 26 in FIG. 7. FIG. 7 also shows cooling waters hose 23*a*, 23*b* connected to the inter-cooler 23.

Figure 2:
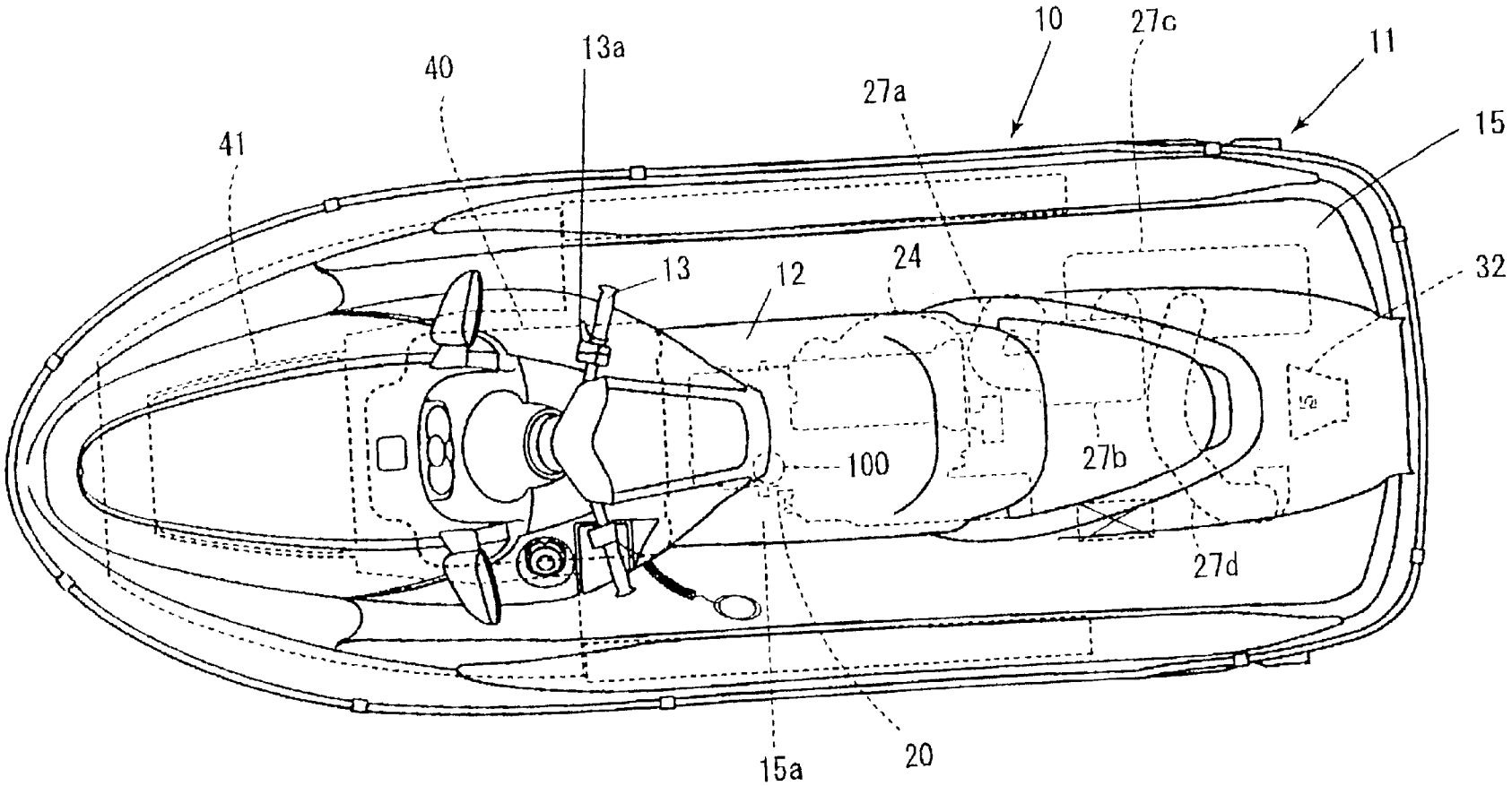
FIG. 2 is a plan view showing the same.
Figure 3:
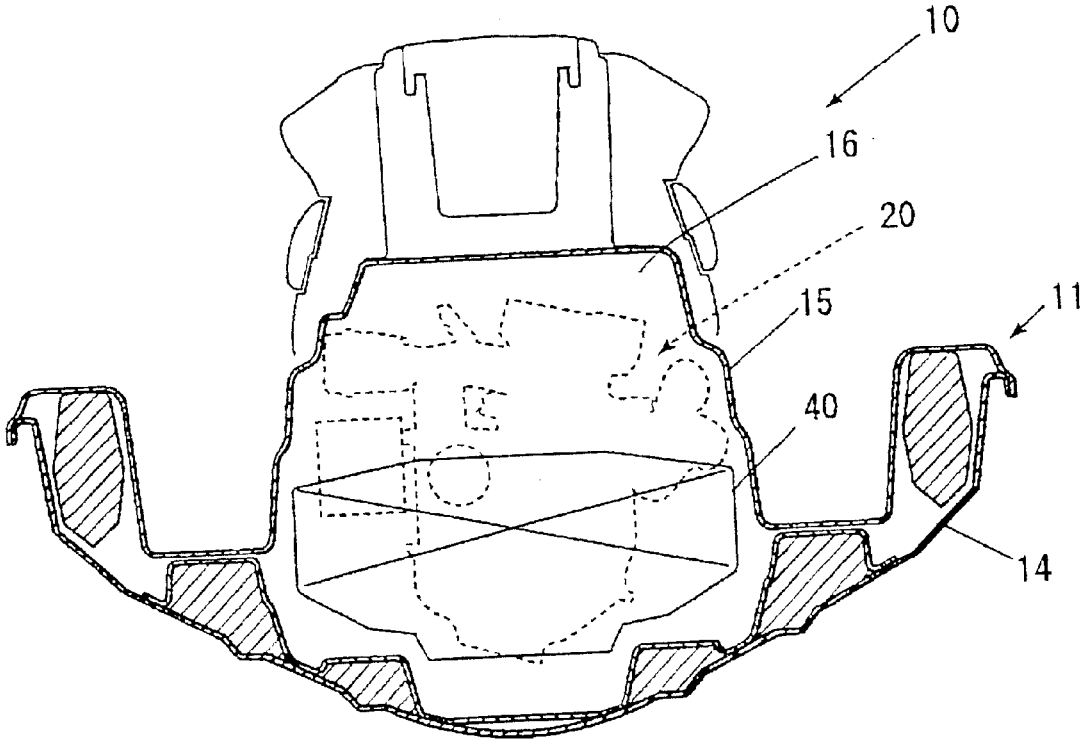
FIG. 3 is an enlarged sectional view taken along a line III—III in FIG. 1 (a partially omitted sectional view)

As can be seen in FIGS. 1 and 2, exhaust gas that has rotated the turbine 25T of turborcharger 25 is exhausted into a stream produced by the jet pump 30 via piping 27*a*, a back flow preventing chamber 27*b* for preventing the back flow of water in rollover (the infiltration of water into the turbocharger 25 and others), a water muffler 27*c*, and an exhaust and discharge pipe 27*d*.

Figure 9A:
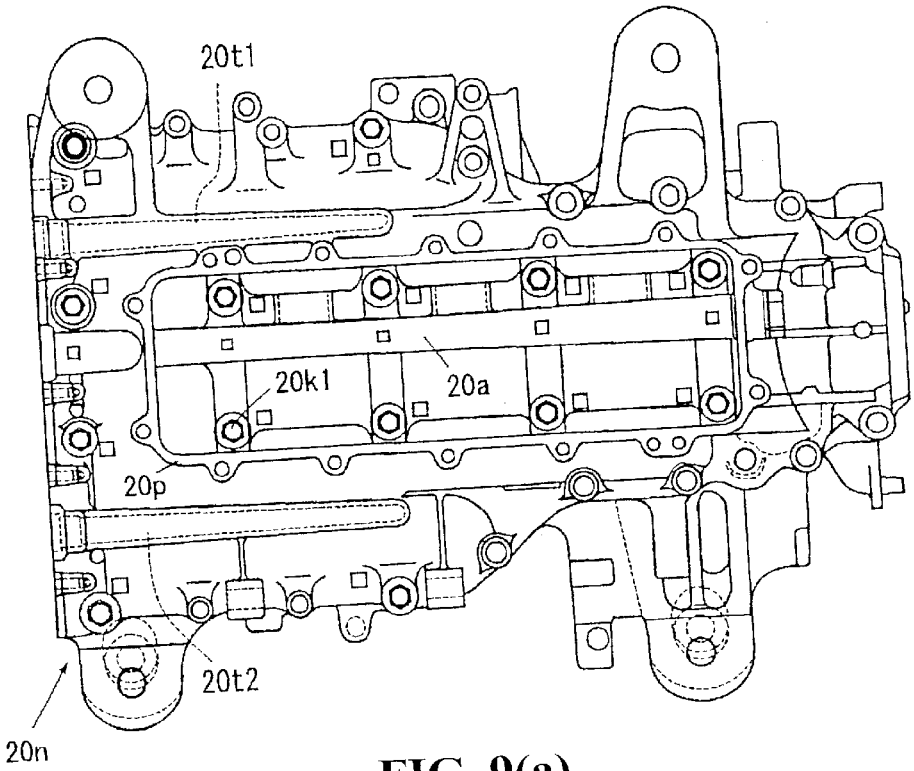
FIG. 9 show an engine block, FIG. 9(*a*) is a bottom view and FIG. 9(*b*) is a left side view of FIG. 9(*a*)
Figure 9B:
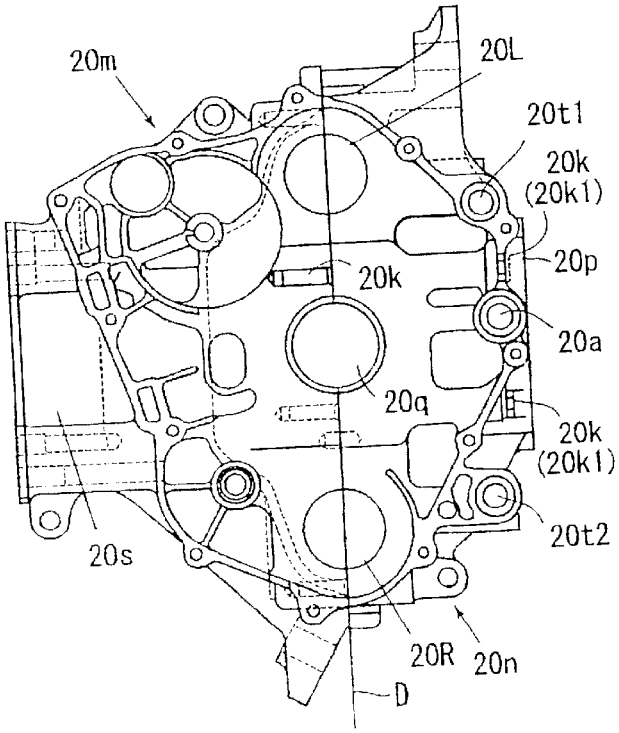

FIG. 9(*a*) shows a bottom view of the engine block, and FIG. 9(*b*) shows the left side view of FIG. 9(*a*).

As shown in FIGS. 9(*a*) and (*b*), the engine 20 is provided with an upper case 20*m* and a lower case 20*n*, respectively divided along a parting face D. In addition, the engine is provided with a bearing 20*q* of the crankshaft 21, and bearings 20L and 20R of a balancer (described later) are formed by clamping the cases 20*m* and 20*n* by clamping bolts 20*k*.

The bottom 20*p* of the lower case 20*n* is located under the head 20*k*1 of the clamping bolt 20*k*, and is open and forms a joining surface to an oil pan 28, or in other fitting plane 20*p* of the oil pan 28.

The fitting plane 20*p* of the oil pan 28 is formed in the shape of a lip, long from side to side when the fitting plane is viewed from the bottom (as shown in FIG. 9(*a*)). Further, the fitting plane 20*p* is provided adjacent to the outside of the clamping bolt 20*k*.

The upper face of the oil pan 28 is open is adapted to join the joining surface 20*p* of the fitting plane.

As shown in FIGS. 4 to 8, an oil tank 50 and an oil pump 80 are integrated on an extended line of the crankshaft 21, in the front of the engine 20 (in a traveling direction of the body 11 and a part on the left in FIGS. 1 and 5). The oil pump 80 is provided inside the oil tank 50.

The oil tank 50 is composed by the body of the tank (one divided case) 60 bonded to the front face of the engine 20 and a cover (the other divided case) 70 bonded to the front face of the body of the tank 60.

FIGS. 10(*a*)–(*d*) show the body of the tank 60. FIG. 10(*a*) is a plan view, FIG. 10(*b*) is a front view, FIG. 10(*c*) is a sectional view viewed along a line c—c in FIG. 10(*b*), and FIG. 10(*d*) is a sectional view viewed along a line d—d in FIG. 10(*a*).

Figure 11:
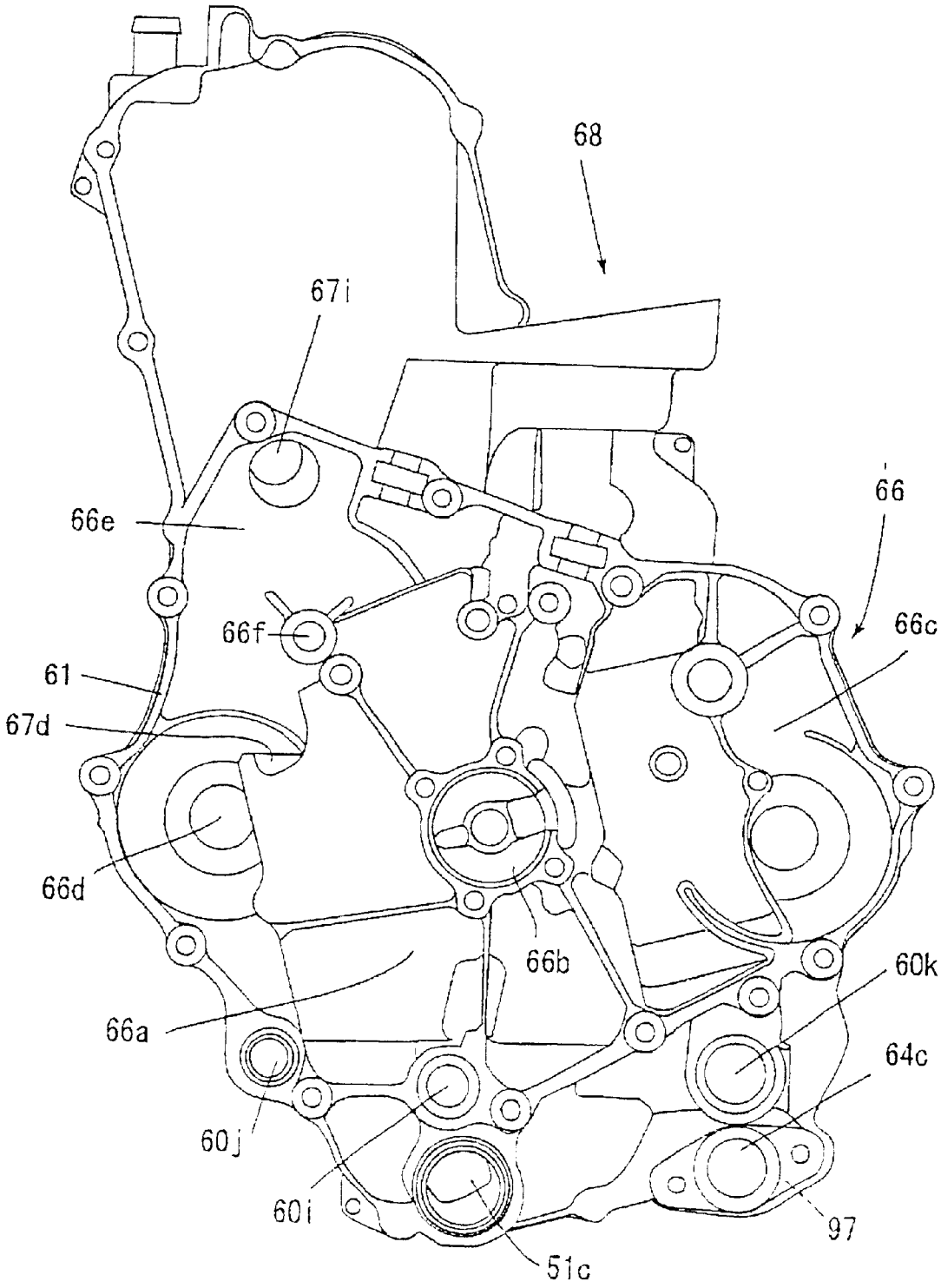
FIG. 11 is a back view showing the body of the tank 60.

FIG. 11 is a rear view, FIG. 12(*a*) is a sectional view viewed along a line e—e in FIG. 10(*b*), and FIG. 12(*b*) is a sectional view viewed along a line f—f in FIG. 10(*b*).

FIGS. 13(*a*)–(*d*) show the cover 70. FIG. 13(*a*) is a front view, FIG. 13(*b*) is a sectional view viewed along a line b—b in FIG. 13(*a*), FIG. 13(*c*) is a sectional view viewed along a line c—c in FIG. 13(*a*), and FIG. 13(*d*) is a sectional view viewed along a line d—d in FIG. 13(*a*).

Figure 14B:
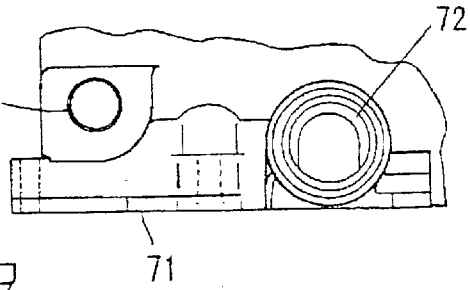
FIG. 14 show the cover 70, FIG. 14(*a*) is a back view, FIG. 14(*b*) is a view viewed from a direction shown by an arrow b in FIG. 14(*a*) and FIG. 14(*c*) is a sectional view viewed along a line c—c in FIG. 14(*a*)
Figure 14A:
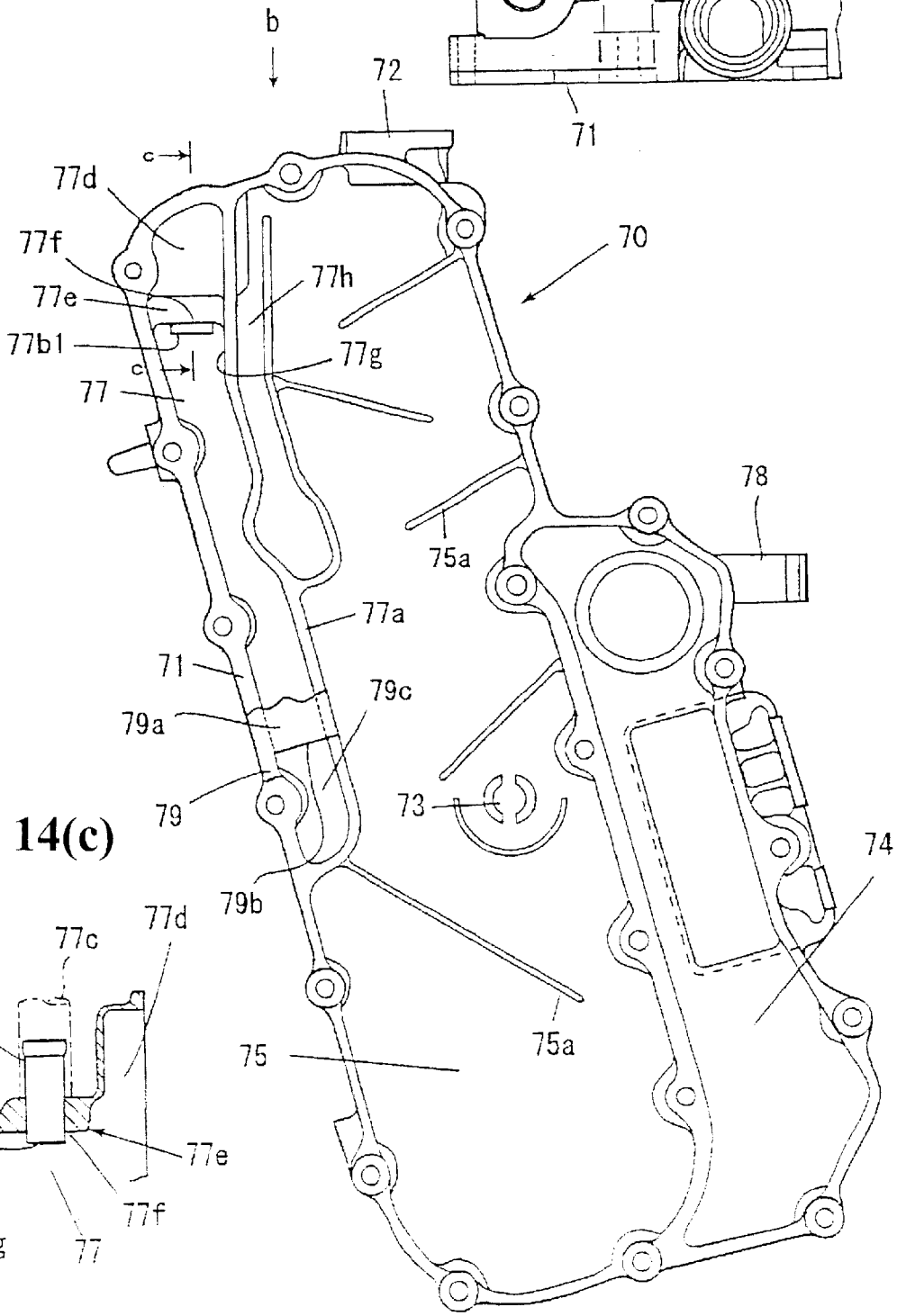
Figure 14C:
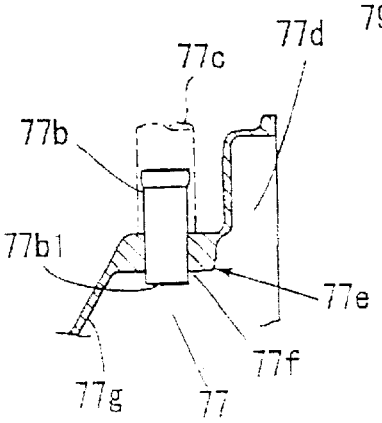

FIGS. 14(*a*)–(*c*) also show the cover 70. FIG. 14(*a*) is a rear view, FIG. 14(*b*) is a view viewed from a direction shown by an arrow b in FIG. 14(*a*), and FIG. 14(*c*) is a sectional view viewed along a line c—c in FIG. 14(*a*).

Figure 15:
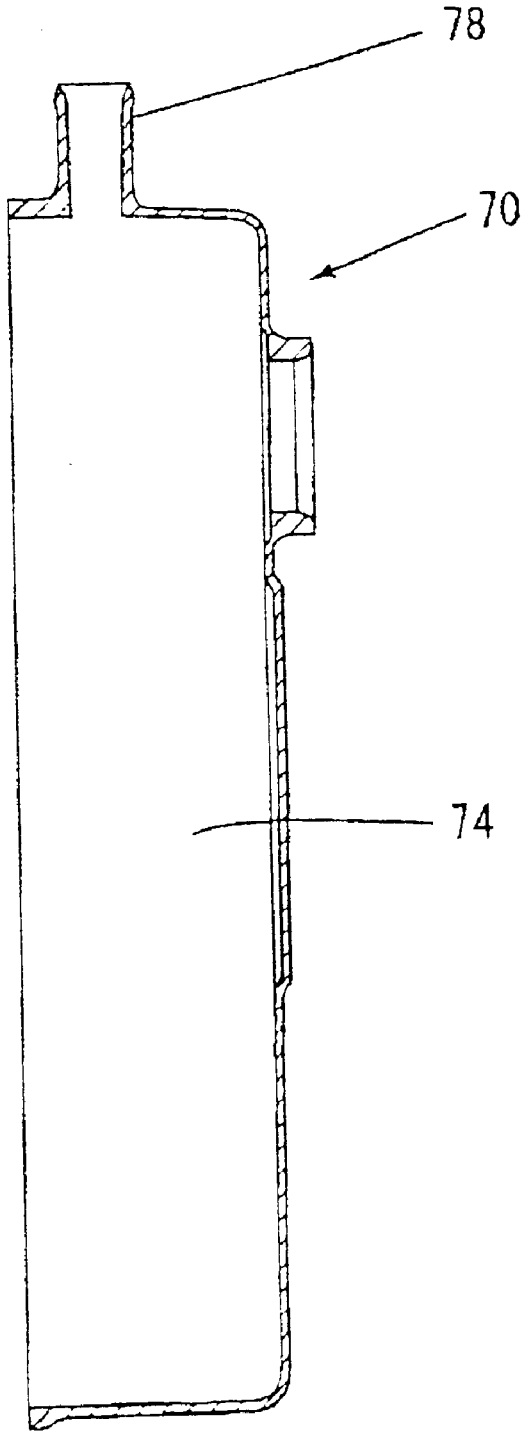
FIG. 15 is a sectional view viewed along a line XV—XV in FIG. 13(*a*)
Figure 16:
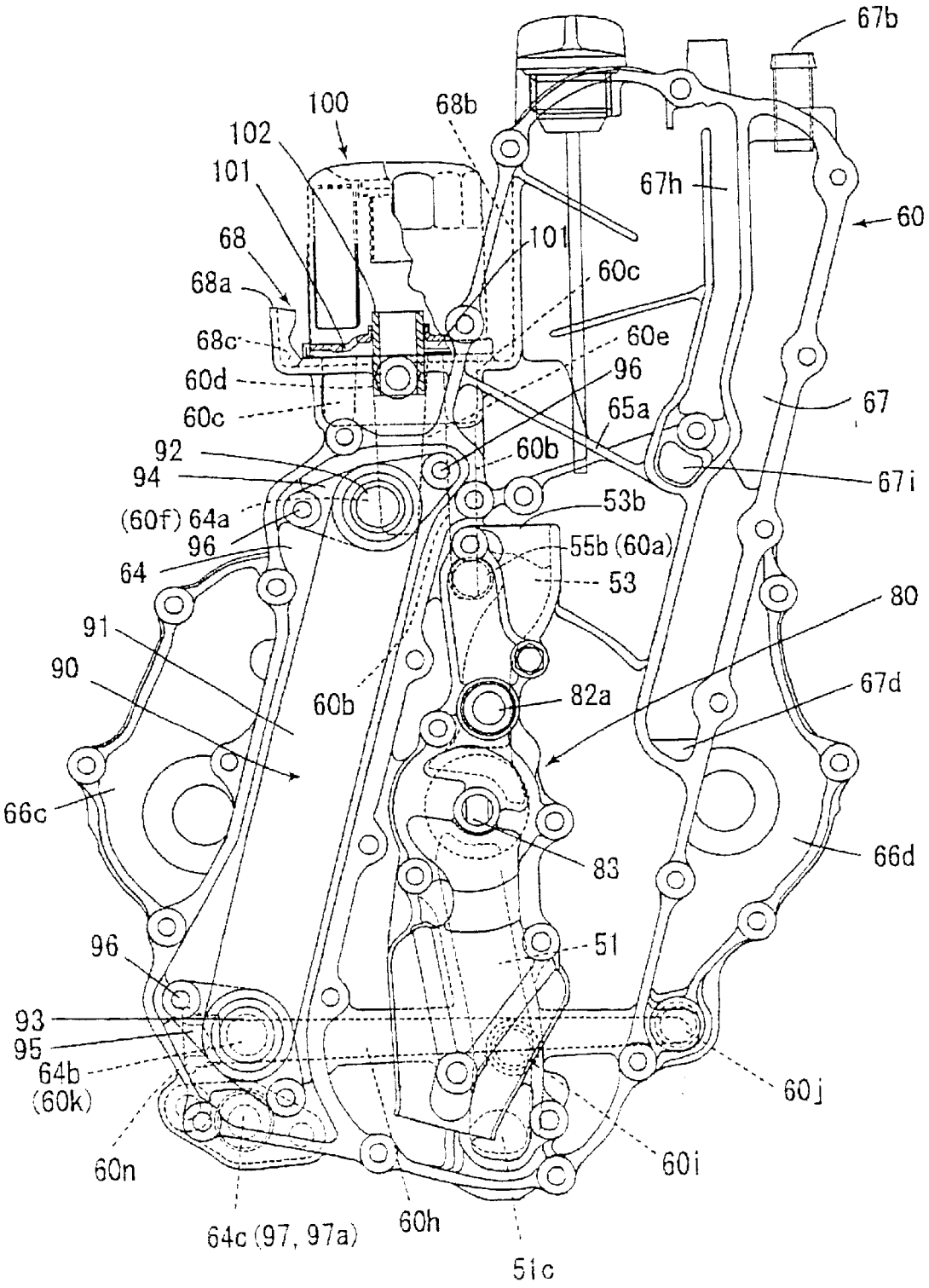
FIG. 16 is a partially enlarged view of FIG. 4.

FIG. 15 is a sectional view viewed along a line XV—XV in FIG. 13(*a*). FIG. 16 is an enlarged view of a part shown in FIG. 4.

As shown in FIGS. 10 and 11, the body of the tank 60 is provided with a joining surface 61 to the front face of the engine 20, a joining surface 62 to the cover 70, a fitting plane 63 of the oil pump 80, and a part 64 for mounting a water-cooled oil cooler 90, to be described later. Further provided are an oil reservoir 65 partitioned by a partition wall and an external wall respectively forming these fitting planes and longer than the width as a whole and a cover 66 of a chamber for driving ACG, a balancer shaft (a balancer), and a starter motor respectively described later. The body of the tank 60 is also provided with a first deputy breather 67 and a part 68 for mounting an oil filter 100, both of which will be explained in detail later.

In the oil reservoir 65, a plurality of baffles 65*a* are formed.

As shown in FIGS. 5 and 8 (mainly FIG. 8), an ACG rotor 110 and is fixed to tile end of the crankshaft 21 by a bolt 112 together with a coupling 111. The coupling 111 is connected to a coupling 89 fixed to the rear end of a pump shaft, to be described later.

As shown in FIGS. 4, 5 and 8, a balancer driving gear 113 is fixed in a state in which it closely touches the back of the ACG rotor 110. The driving gear 113 rotates a balancer 114R because it is engaged with a balancer gear 115 fixed to the end of the balancer 114R (shown in FIG. 6) arranged in parallel with the crankshaft 21 on the right (on the left in FIG. 4) inside the engine 20 via an idle gear 16 as shown in FIG. 4. The driving gear 113 simultaneously rotates a balancer 114L in a direction reverse to the rotation of the balancer 114R. This occurs because the driving gear is directly engaged with a gear 117 fixed to the end of the balancer 114L arranged in parallel with the crankshaft 21 on the left inside the engine 20 (on the right in FIG. 4).

These left and right balancers 114L and 114R are arranged on the left and on the right of the crankshaft 21 on the parting face D between the upper case 20*m* and the lower case 20*n*. They are supported by the bearings 20L and 20R, so that the balancers 114L and 114R are able to rotate.

As shown in FIG. 4, a starter motor 120 has a pinion gear 121 which is engaged with a gear for a starter 123 via a reduction gear 122.

The gear for the starter 123 is coupled to the balancer driving gear 113 via a one-way clutch 124 as shown in FIG. 8. Further, the balancer driving gear 113 is arranged on the periphery of the one-way clutch, and is fixed to the back of the ACG rotor 110.

The axis of the starter motor 120, and each axis of the balancers 114L and 114R, are arranged in parallel. The idle gear 116 of one balancer 114R is arranged on the side reverse to the starter motor 120 with the crankshaft 21 between them, and is arranged on the side reverse to the starter motor 120, with a cylinder 20*s* shown in FIGS. 5 and 9 between them.

As shown in FIGS. 8, 10 and 11, the cover 66 of the body of the tank 60 is provided with an ACG cover 66*a* covering the ACG rotor 110, the balancer driving gear 113 and the gear for the starter 123. The cover 66 also includes a coupling cover 66*b* covering the coupling 111, a cover 66*c* for a right balancer driving system covering the balancer gear 115 and the idle gear 116, a cover 66*d* for a left balancer driving system covering the balancer gear 117 and a cover 66*e* for a starter driving system covering the pinion gear 121 of the starter motor 120 and the reduction gear 122. A hole 66*f* Supports the shaft of the reduction gear 122.

As shown in FIG. 8, a pulser 118 is provided on the periphery of ACG for taking a pulse signal, and is attached to the coupling cover 66*b* in the ACG cover 66*a*. Being so mounted, the pulser 118 overlaps with the oil tank 50 in the axial direction of the crankshaft 21.

The body of the tank 60 is bonded to the front face of the engine 20 on the joining surface 61 with the cover 66 covering each part described above, and is integrated with the front face of the engine 20 by a bolt, not shown. The body of the tank 60 is attached to the front face of the engine 20 after the oil pump 80 and the oil cooler 90, respectively, are attached to the body.

As shown in FIGS. 13 to 15, the cover 70 is provided with a joining surface 71 to the body of the tank 60, an oil support port 72, a relief valve pressing part 73, an oil cooler housing 74, an oil reservoir 75 partitioned by an external wall and a partition wall and a second deputy breather 77. These elements will be described in detail later.

A plurality baffles 75*a* are foxed in oil reservoir 75.

FIGS. 17(*a*)–(*b*) show the oil pump 80, with FIG. 17(*a*) being a front view, and FIG. 17(*b*) being a sectional view viewed along a line b—b in FIG. 17(*b*).

As shown in FIGS. 17 and 8, the oil pump 80 is provided with a first case 81 bonded to the body of the tank 60, a second case 82 bonded to the first case 81, a pump shaft 83 that pierces the first and second cases, and an inner rotor 84*a* connected to the pump shaft 83 in the first case 81 for retrieving oil. In addition, oil pump 80 includes an outer rotor 84*b* provided on the periphery of the inner rotor 84*a* so that the outer rotor can be rotated, an inner rotor 85*a* connected to the pump shaft 83 in the second case 82 for supplying oil and an outer rotor 85*b* provided on the periphery of the inner rotor 85*a* so that the outer rotor can be rotated. Dowel pin 86 is shown also.

The inner rotor 84*a* for retrieving oil and the outer rotor 84*b* compose an oil retrieving pump together with the first case 81. The inner rotor for supplying oil 85*a* and the outer rotor 85*b* compose all oil supply pump, together with the first and second cases 81 and 82.

After the oil pump 80 is assembled as shown in FIG. 17 and the first case 81 and the second case 82 are connected by a bolt 87, a joining surface 81*a* opposite to the body of the tank 60 of the first case 81 is bonded to a joining surface 69 on the front face of the body of the oil tank 60, formed at the same time as the joining surface 81*a* and shown in FIGS. 10(*b*) and 10(*c*). A bolt 88, shown in FIG. 8, is inserted into a through hole 80*a* of the first and second cases 81 and 82, and the first and second cases are attached to the front face of the body of the tank 60 by the bolt 88.

After the oil pump 80 is attached to the body of the tank 60, as described above, the coupling 89 is fixed to the rear end of the pump shaft 83 by a bolt 89(*a*) from the back side of the body of the tank 60.

Therefore, after the oil pump 80 and its coupling 89 are attached to the body of the tank 60 as described above. Further, the oil cooler 90 is attached to the body of the tank 60, as described below, and the coupling 89 is attached to the front face of the engine 20, so that the coupling 89 is connected to the coupling 11.

As shown in FIGS. 6 and 10(*b*), the water-cooled oil cooler 90 is attached to the front side of the part 64 for mounting the oil cooler 90 in the body of the tank 60.

An upper hole 64*a* and a lower hole 64*b* are formed, respectively, for communicating with an oil passage (described later) in the mounting part 64 in the body of the tank 60.

In the meantime, the oil cooler 90 is provided with plurality of plates 91 for heat exchange, the inside of each of which oil passes. Further provided in the oil cooler 90 are an oil inlet pipe 92 communicating with an upper part of this plate 91, an oil outlet pipe 93 communicating with a lower part of the plate 91, and flanges 94 and 95 shown in FIC. 16 for mounting to the body of the tank 60.

Therefore, the oil cooler 90 is attached to the mounting part 64 in the body of the tank 60 by respectively clamping the flanges 94 and 95 by a bolt (not shown), so that the inlet pipe 92 is coupled into the upper hole 64*a* of the body of the tank 60, and the outlet pipe 93 is coupled into the lower hole 64*b* of the body of the tank 60. As shown in FIG. 16, holes 96 for inserting a bolt are respectively provided to the flanges 94 and 95.

A cooling water injecting pipe 97 communicating with a hole 64*c* open to the mounting part 64 (shown in FIG. 16) for injecting cooling water into the mounting part 64 and the oil cooler housing 74 in the cover 70 is provided in the body of the tank 60. A drainage pipe 78 is provided in the cover 70 as shown in FIGS. 13 to 15. Cooling water hose 97*a* from a cooling water outlet 30*a* shown in FIG. 7 in the jet pump 30 is directly connected to the injecting pipe 97. No other objected is cooled by the injecting pipe 97.

A drainage pipe 23*c* is connected to the drainage pipe 78, as shown in FIG. 6. Water from the drainage pipe 78 is supplied to a water jacket of the exhaust manifold 24 via the drainage pipe 23*c*.

For the cover 70, after the body of the tank 60, the oil pump 80 and the oil cooler 90 are attached to the front face of the engine 20, the rear end 131 of a relief valve 130 is fitted into a hole 82*a* formed on the front face of the second case 82 of the oil pump 80 as shown in FIGS. 8 and 17. Also, the cover is bonded to the front face of the body of tile tank 60 in a state in which the end 132 of the relief valve 130 is pressed by the pressing part 73 and is fixed by a bolt (not shown). FIG. 13(*a*) shows hole 76, into which the bolt is inserted. FIG. 8 shows the relief valve 130 arranged horizontally.

In a state in which the body of the tank 60 and the cover 70 are bonded, a single oil reservoir, having a length longer than its width, is formed by both oil reservoirs 65 and 75. The baffles 65*a* and 75*a*, formed opposite in both oil reservoirs, are bonded by bonding the body of the tank 60 and the cover 70.

The oil filter 100 is mounted on a mounting part 68 in the body of the tank 60.

In a state in which the engine 20 is mounted in the body of the boat 11, the engine 20 and the oil filter 100 are opposite to an opening 15*a* of the deck 15 as shown in FIGS. 2 and 4. The opening 15*a* of the deck 15 is opened by detaching the seat 12 from the body of the boat 11.

As described above, an oil recovery passage 51 is formed when the oil tank 50 and the oil filter are mounted on the front face of the engine 20 (that is, the body of the tank 60, the cover 70, the oil pump 80, the oil cooler 90 and the relief valve 130 respectively built in them).

As shown in FIGS. 5 and 8, an oil recovery passage 51 is formed by the front face of the body of the tank 60 and the back of the first case 81 of the oil pump 80. The recovery passage 51 is formed by an oil passage 51*a* shown in FIG. 10(*b*), and formed on the side of the body of the tank 60 and an oil passage 51*b* formed opposite to tile oil passage 51*a* on the side of the first case 81 of the oil pump 80.

The lower end 51*c* of the oil recovery passage 51 communicates with the oil pan 28 of the engine 20 via a pipe 52, and tile upper end 51*d* communicates with a recovered oil intake port 81*i* formed in the first case 81 of the oil pump 80.

Similarly, a recovered oil discharge passage 53 is formed by the front face of the body of the tank 60 and the back of the first case 81 of the oil pump 80. The recovered oil discharge passage 53 is formed by an oil passage 53*a* shown in FIG. 10(*b*), and formed on the side of the body of the tank 60, and a recovered oil discharge port 81*o* formed opposite to the oil passage 53*a* on the side of the first case 81 of the oil pump 80.

The upper end 53*b* of the recovered oil discharge passage 53 is open to the oil tank 50 (that is, the oil reservoir) as shown in FIGS. 10(*b*) and 16.

In the meantime, as shown in FIG. 8, a supply oil intake passage 54 and a supply oil discharge passage 55 are formed by the front face of the first case 81 of the oil pump 80 and the back of the second case 82.

The lower end 54*a* of the intake passage 54 is open to the oil tank 50 (that is, the oil reservoir) and the upper end 54*b* communicates with a supply oil intake port 82*i* shown in FIG. 17(*b*) of the oil supply pump. A screen oil filter 54*c* is provided to the intake passage 54.

The lower end 55*a* of the discharge passage 55 communicates with a supply oil discharge port 82*o* of the oil supply pump. Further, the upper end 55*b* pierces an upper part of the first case 81 horizontally, and communicates with a horizontal hole 60*a* formed in the body of the tank 60, as shown in FIGS. 10(*b*) and 16. The horizontal hole 60*a* communicates with a longitudinal hole 60*b* similarly formed in the body of the tank 60, as shown in FIGS. 8, 10(*b*) and 16. The upper end 60*c* of the longitudinal hole 60*b* is open to the mounting part 68 of the oil filter 100 in the shape of a ring when the upper end is viewed from the top, as shown in FIGS. 10(*a*) and 12(*a*). FIG. 16 shows an oil inflow passage 101 of the oil filter 100 communicating with the opening 60*c*.

The fitting hole 82*a* of the relief valve 130 is open to the discharge passage 55, and the relief valve 130 is fitted into the fitting hole 82*a*.

A male screw is provided to an oil outlet pipe 102 in the oil filter 100. The oil filter 100 is attached to the mounting part 68 of the body of the tank 60 by fitting the oil outlet pipe 102 into a female screw hole 60*d* formed in the mounting part 68 in the body of the tank 60 and shown in FIGS. 10(*a*), 10(*b*), 12(*a*), and 16.

A peripheral wall 68*a* is integrated with the mounting part 68, and an oil acceptor 68*c* is formed by the peripheral wall 68*a* and the side wall 68*b* of the body of the tank 60 continuing to the peripheral wall. Therefore, as oil which may drop when the oil filter 100 is detached from the mounting part 68 is received by the oil acceptor 68*c*, and is returned into the oil tank via the female screw hole 60*d* or the opening 60*c*, the body of the boat is protected from being contaminated by oil.

As shown in FIGS. 10(*a*), 10(*b*), 12(*a*), and 16, a longitudinal hole 60*e* and a horizontal hole 60*f* communicating with the lower end of the longitudinal hole 60*e* are formed below the female screw hole 60*d*. Further, the horizontal hole 60*f* communicates with the inlet pipe 92 of the oil cooler 90 via an upper hole 64*a* in the mounting part 64 of the oil cooler 90, as shown in FIGS. 6 and 16.

In the meantime, an oil passage 60*g* communicating with the lower hole 64*b*, and an oil distributing passage 60*h* communicating with the passage 60*g*, are formed in the lower hole 64*b* of the body of the tank 60, to which the outlet pipe 93 of the oil cooler 90 is connected, as shown in FIG. 12(*b*).

Further, as shown in FIG. 5, a supply passage for a main gallery 60*i* for supplying oil to the main gallery 20*a* of the engine 20, a supply passage for the left balancer 60*j* for supporting oil to the bearing (the supporting part) 20L of the left balancer 114L, and a supply passage for the right balancer 60*k* for supplying oil to the bearing (the supporting part) 20R of the right balancer 114R, are provided for communicating with the oil distributing passage 60*h*.

The supply passages 60*j* and 60*k* for the balancers (L,R) communicate with the oil distributing passage 60*h* respectively via a narrow passage (a restrictor) 60*m*.

The supply passages 60*j* and 60*k* for the balancers 114 (L,R) are connected to oil passages 20*t*1 and 20*t*2 communicating with the bearings 20L and 20R of the balancers 114 (L, R). As shown in FIGS. 6 and 9, bearings 20L and 20R are formed in the lower case 20*n* of the engine.

One end 60*h*1 of the oil distributing passage 60*h* is closed by a plug 60*n* shown in FIG. 6.

Figure 18:
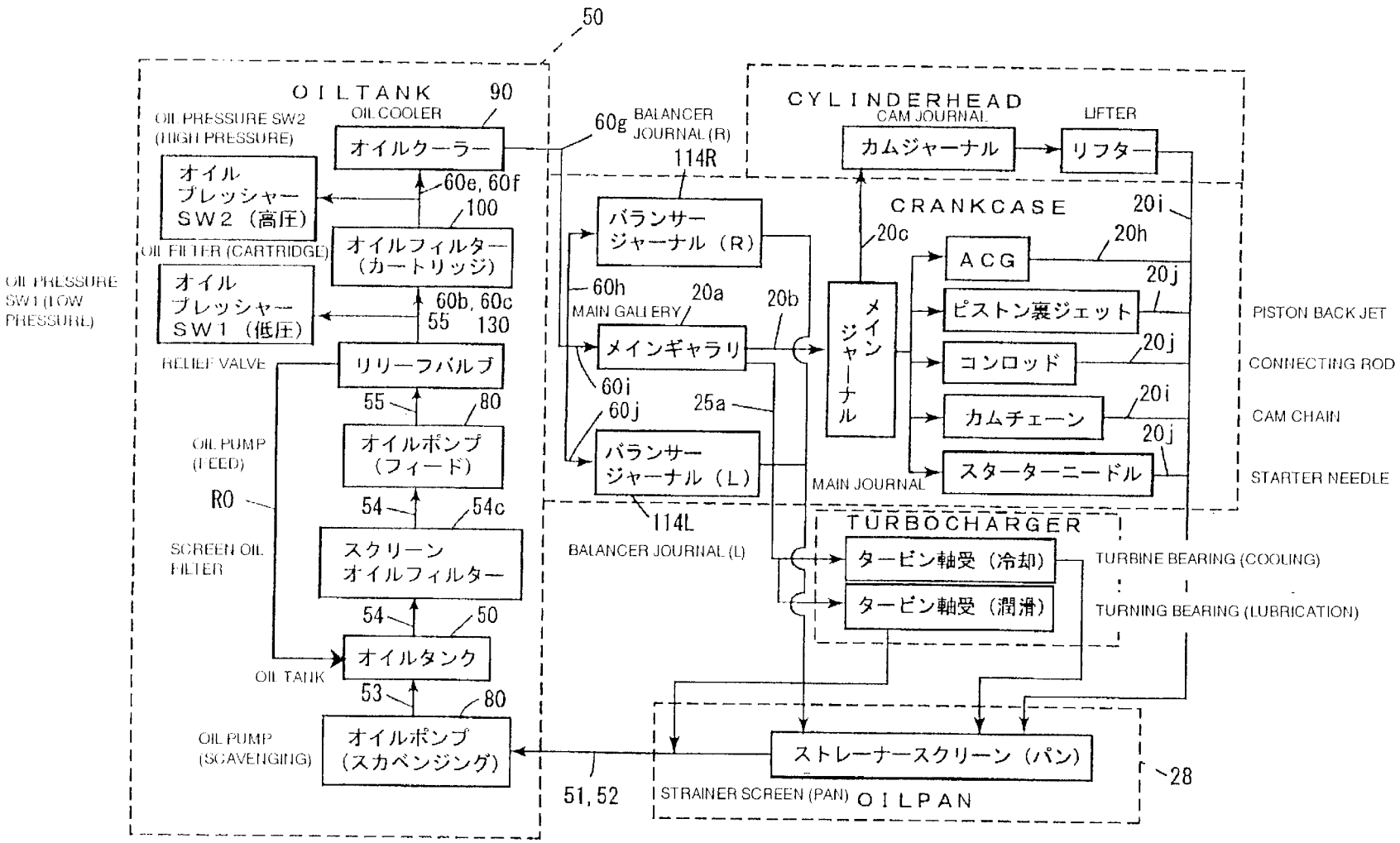
FIG. 18 shows a path of circulating oil.

FIG. 18 shows a path of all supplied to the main gallery 20*a* of the engine 20 (a circulating path of oil).

The path from the main gallery 20*a* can be classified into two main parts.

The first path is a path through which oil is supplied to the bearing of the crankshaft (a main journal) 21 via a path 20*b*, as shown in FIG. 5. The second path is a path through which oil is supplied from the rear end 20*a*1 of the main gallery 20*a* to the bearing of a turbine of a turbocharger 25 for cooling and lubrication via a pipe 25*a*, as shown in FIG. 7. Oil that cools and lubricates the bearing of the turbine of the turbocharger 25 is collected in the oil pan 28 via pipes 25*b* and 25*c* shown in FIG. 6.

As shown in FIG. 5, oil supplied to the bearing of the crankshaft 21 is returned to the oil pan 28, both via a chain chamber 20*i* after the oil further lubricates a cam journal 20*d*, and also, via path 20*c* from a lifter in a cylinder head.

Oil supplied to the bearing of the crankshaft 21 is further supplied to ACG, a jet nozzle at the back of a piston, a connecting rod, a cam chain and a starter needle and is collected in the oil pan 28 via the respective recovering passages. FIG. 5 shows a jet nozzle 20*e* that jets oil toward the back of the piston for cooling the piston, a passage 20*f* to the connecting rod, a cam chain 20*g*, and a passage 20*h* for returning oil from an ACG chamber 110(*c*).

Oil in the ACG chamber is returned to the oil pan 28 via the returning passage 20*h* and oil jetted toward the back of the piston via the jet nozzle 20*e*, oil supplied to the connecting rod and oil supplied to the starter needle are returned to the oil pan 28 via a crankcase 20*j*.

As clear from the description, the overall flow of oil is as follows mainly referring to FIG. 18.

Oil is supplied to the left balancer 114L and the right balancer 114R from the oil tank 50 via the intake passage 54, the screen oil filter 54*c*, the oil pump (tile supply pump) 80, the discharge passage 55 (and the relief valve 130, the horizontal hole 60*a*, the longitudinal hole 60*b*, the ring-shaped opening 60*c*), and the oil filter 100. Oil is also supplied to the right and left balancers from the longitudinal hole 60*e*, the horizontal hole 60*f*, the oil cooler 90, the oil passage 60*g*, the oil distributing passage 60*hi*, the supply passage for the main gallery 60*i*, the supply passage for the left balancer 60*j*, the supply passage for the right balancer 60*k* and the main gallery 20*a*.

Relief oil RO from the relief valve 130 is directly returned into the oil tank 50. Oil supplied to the left balancer 114L and the right balancer 114R is returned to the oil pan 28 via the crankcase 20*j*.

Oil supplied to each part described above from the main gallery 20*a* is returned to the oil pan 28, as described above.

Oil returned to the oil pan 28 is collected in the oil tank 50 via the pipe 52, the recovery passage 51, the oil pump (the oil recovery pump) 80 and the recovered oil discharge passage 53, and then is circulated, via the path described above, from the intake passage 54.

As described above, the first deputy breather 67 is formed in the body of the tank 60, and the second deputy breather 77 is formed in the cover 70.

As shown in FIG. 10(*b*), the first deputy breather 67 is partitioned from the oil reservoir 65 in the body of the tank 60 by a partition 67*a*. Similarly, as shown in FIG. 14(*a*), the second deputy breather 77 is partitioned from the oil reservoir 75 in the cover 70 by a partition 77*a*.

These deputy breathers 67 and 77 are formed so that the longitudinal dimension is longer than the lateral dimension.

The joining surface 62 of the body of the tank 60 and the joining surface 71 of the cover 70 are bonded via a metal gasket 79 a part of which is shown in FIG. 14(*a*). The metal gasket 79 is basically made in a shape matched with the joining surface 62 and the joining surface 71. However, the metal gasket 79 extends inside in the first deputy breather 67 and the second deputy breather 77, where an extended part 79(*a*) functions as a diaphragm for partitioning the first deputy breather 67 and the second deputy breather 77. However, the extended part 79(*a*) does not completely partition the first deputy breather 67, so that the second deputy breather 77, the lower end 79(*b*) is open downward, and the first deputy breather 67, and the second deputy breather 77 communicate via an open part 79*c*.

In the body of the tank 60 and the cover 70, breathing passages 67*h* and 77*h* shown in FIG. 10(*c*) and 14(*a*) are formed in the oil reservoirs next to the first and second deputy breathers 67 and 77. These breathing passages 67*h* and 77*h* form a single breathing passage when the body of the tank 60 and the cover 70 are bonded. The lower end of the breathing passage 67*h* on the side of the body of the tank 60 communicates with the cover 66 via an opening 67*i* as shown in FIG. 11. Thus, the oil reservoir of the oil tank 50 is also provided with a breathing function.

As shown in FIG. 10, a breathing gas inlet pipe 67*b* communicating g with the first deputy breather 67 is provided to an upper part of the first deputy breather 67.

In the meantime, as shown in FIG. 4, a main breathing chamber 29(*a*) is formed inside a head cover 29 of the engine 20. The head cover 29 is made so that the capacity of the main breathing chamber 29(*a*) is as small as possible, in order to reduce the overall height of the engine 20 as much as possible. A breathing gas outlet pipe 29(*b*) is provided to the head cover 29, and is connected to the inlet pipe 67*b* of the first deputy breather 67 via a breather pipe 67*c*.

As shown in FIGS. 13(*a*) and 14(*a*)–(*c*), a breathing gas outlet pipe 77*b* communicating with an upper part of the second deputy breather 77 is provided to the upper part of the second deputy breather 77. The outlet pipe 77*b* is provided in a lower position, compared with the inlet pipe 67*b* of the first deputy breather 67 as shown in FIG. 4. As can be seen in FIG. 14(*c*), the outlet pipe 77*b* is connected to an intake box (not shown) located on the upstream of the turbocharger 25 in an intake system of the engine 20 via a breatherpipe pipe 77*c*, thus returning the breathing gas to the intake box.

As shown in FIGS. 8, 10(*a*), 10(*b*), and 11, a return passage 67*d* for recovering oil separated in the first and second deputy breathers 67 and 77 is provided to the lower end of the first deputy breather 67. The return passage 67*d* is formed in the body of the tank 60 and communicates with the ACG chamber 110(*c*). Therefore, oil separated in the first and second deputy breathers 67 and 77 enters the ACG chamber 110(*c*) via the return passage 67*d*, and is returned to the oil pan 28 via the returning passage 20*h*.

According to the breather structure described above, in normal operation, breathing gas generated in the engine 20 enters the main breathing chamber 29(*a*) in the head cover 29, and enters the first deputy breather 67 via the breather pipe 67*c*. The breathing gas also enters the second deputy breather 77 via the open part 79*c*(a connection passage between the first deputy breather 67 and the second deputy breather 77) at the lower end and is returned to the intake box from the outlet pipe 77*b* via the breather pipe 77*c*.

Oil separated in a process between the first deputy breather 67 and the second deputy breather 77 is returned to the oil pan 28 via the return passage 67*d*, the ACG chamber 110(*c*), and the returning passage 20*h*.

As this type small-sized planing boat is mainly utilized for leisure, it is likely to be overturned. However, as described below, the structure of the present invention is such that oil is prevented from flowing outside an oil path in the engine 20 and the oil tank 50.

Figure 19B:
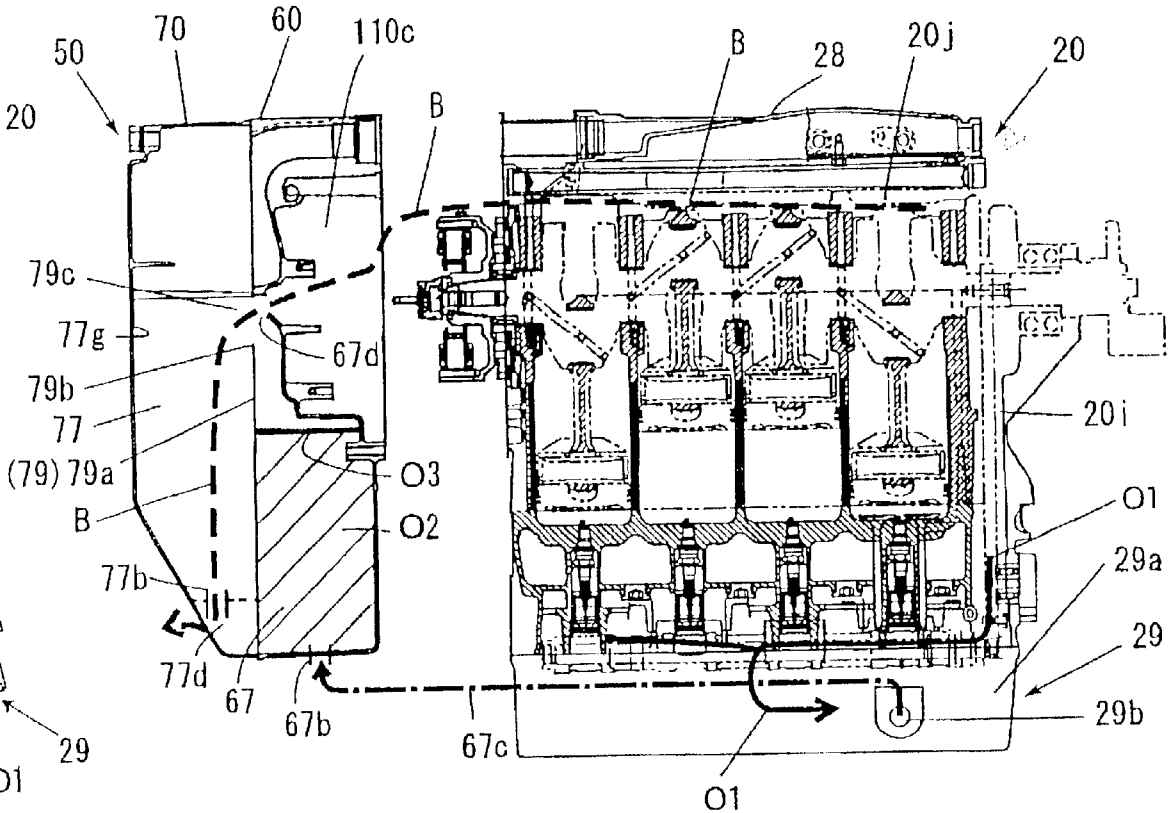
FIG. 19 schematically show the engine 20 and an oil tank 50 when a boat 10 is upset, FIG. 19(*a*) is a front view and FIG. 19(*b*) is its side view.
Figure 19A:
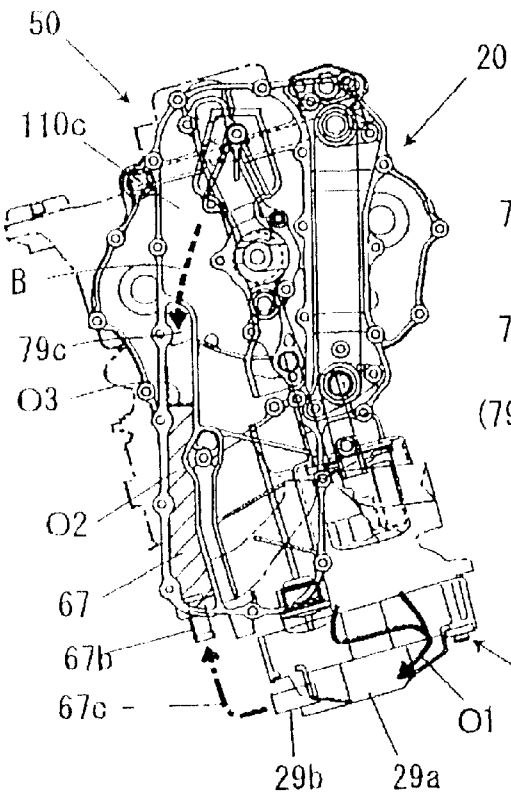

FIGS. 19(*a*) and (*b*) schematically shows the engine 20 and the oil tank 50 when the boat 10 is upset, where FIG. 19(*a*) is a front view, and FIG. 19(*b*) is a side view.

For clarity as ease of understanding, the engine 20 and the oil tank 50 are shown to be separate from each other in FIG. 19(*b*).

As shown in FIGS. 19(*a*) and (*b*), when the boat 10 is upset and the engine 20 and the oil tank 50 are turned over, oil in the crankcase 20*j* of the engine 20 and oil pan 28 flows into the main breathing chamber 29(*a*), downwardly as shown by an arrow O1. Oil in the oil pan 28 flows into the main breathing chamber 29(*a*) mainly via the chain chamber 20*i* downward.

As described above, since the capacity of the main breathing chamber 29(*a*) is reduced to lower the overall height of the engine 20 as much as possible, all oil in the engine 20 cannot be housed in the main breathing chamber 29(*a*). A further part of the oil flows into the first deputy breather 67 via the breather pipe 67*c*. As shown by the oblique lines O2, oil flows into the first deputy breather 67. The upper surface of the oil is designated as 03. As shown in FIGS. 19(*a*) and (*b*), oil flows into the first deputy breather 67. However, as shown in FIG. 14(*a*), since the first deputy breather 67 and the second deputy breather 77 are partitioned by the extended part 79(*a*) of the metal gasket 79, no oil flows into the second deputy breather 77.

In other words, the capacity of the first deputy breather 67 or the lower end (the upper end in upset) 79(*b*) of the extended part 79(*a*) of the metal gasket 79 is designed so that no oil flows into the second deputy breather 77 when the boat is upset. Further, when the boat is upset, the total of the capacity of an oil reservoir by the first deputy breather 67 defined by the inner wall of the body of the tank 60, the extended part 79(*a*) of the metal gasket 79 and the lower end of the extended part 79(*b*), and the capacity of an oil resevoior formed in an upper part (a lower part in upset in the main breathing chamber 20*a* and the cylinder head) of the engine 20, is designed so that no oil flows into the second deputy breather 77. Therefore, the total quantity of oil circulating in the engine 20 and the oil tank 50 is also designed so that no oil flows into the second deputy breather 77 when the boat is upset.

As described above, since no oil flows into the second deputy breather 77 when the boat is upset, oil cannot flows into the intake box via the second deputy breather 77, vat the outlet pipe 77*b*, or via the breather pipe 77*c* connected to the outlet pipe.

If oil could flow into the breather pipe 77*c* connected to the outlet pipe 77*b* of the second deputy breather 77 when the boat is upset, the oil would flow toward the intake box when the boat 10 is restored again, in which case it may contaminate the body of the boat. If this were to occur, there would be the possibility of environmental contamination of the sea.

However, according to breather structure in this embodiment, there is no situation in which oil can flow into the breather pipe 77*c* toward the intake box when the boat is upset. Since oil is prevented from flowing outside the oil path in the engine 20, the oil tank 50 and others, the environment cannot be contaminated.

As described above, when the boat is upset, the gas-liquid separation of breathing gas is made in the first and second deputy breathers 67 and 77, the separated oil enters the ACG chamber 110(*c*) via the return passage 67*d* provided to the lower end of the first deputy breather 67. The separated oil is then returned to the oil pan 28 via the returning passage 20*h*. Further, oil adhering to the wall 77*g* of the second deputy breather 77 and oil at the lower end of the second deputy breather 77, and oil in the return passage 67*d*, flows gradually along the inner wall 77*g* of the second deputy breather 77 toward the side of the outlet pipe 77*b* of the second deputy breather 77.

Then, in this embodiment, as shown in FIGS. 14(*a*)–(*c*), an oil reservoir 77*d* is provided to the upper part of the second deputy breather 77, in case the boat is upset.

The oil reservoir 77*d* is formed opposite to an opening 77*b*1 to the second deputy breather 77 of the outlet pipe 77*b* via a part having difference in a level 77*e*. The opening 77*b*1 protrudes from the lower surface (the upper surface in upset) 77*f* of the part having differences in a level 77*e*, and is not in contact with the inner wall 77*g* of the second deputy breather 77.

Therefore, when the boat is upset, even if oil adhering to the wall of the second deputy breather 77, oil at the lower end of the second deputy breather 77, and oil in the return passage 67*d*, flow along the inner wall 77*g* of the second deputy breather 77 toward the side of the outlet pipe 77*b*, oil is received in the oil reservoir 77*d* and accumulates there, and does not flow into the outlet pipe 77*b*.

Therefore, the leakage of oil into the boat 10 can be prevented more securely.

In the meantime, when the boat is upset, the engine 20 may continue to rotate, particularly during the time immediately after the boat has been upset.

If no measure is taken in such a situation, oil that flows from the main breathing chamber 29(*a*) into the first deputy breather 67 may exceed the lower end 79(*b*) of the extended part 79(*a*) of the metal gasket 79 because of the pressure of breathing gas gradually increasing in the engine 20, and thus flows into the second deputy breather 77. The present invention prevents this problem however. As shown by a broken line B in FIGS. 19(*a*) and (*b*), the boat of the present invention includes the breathing passage from the crankcase 20*j* to the intake box via the ACG chamber 110(*c*), the return passage 67*d*, the open part 79*c* of the metal gasket 79, the second deputy breather 77, the outlet pipe 77*b* and the breather pipe 77*c*. In other words, when the boat is upset, the return passage 67*d* forms the breathing passage. Therefore, according to this embodiment, no problem may occur.

Figure 20B:
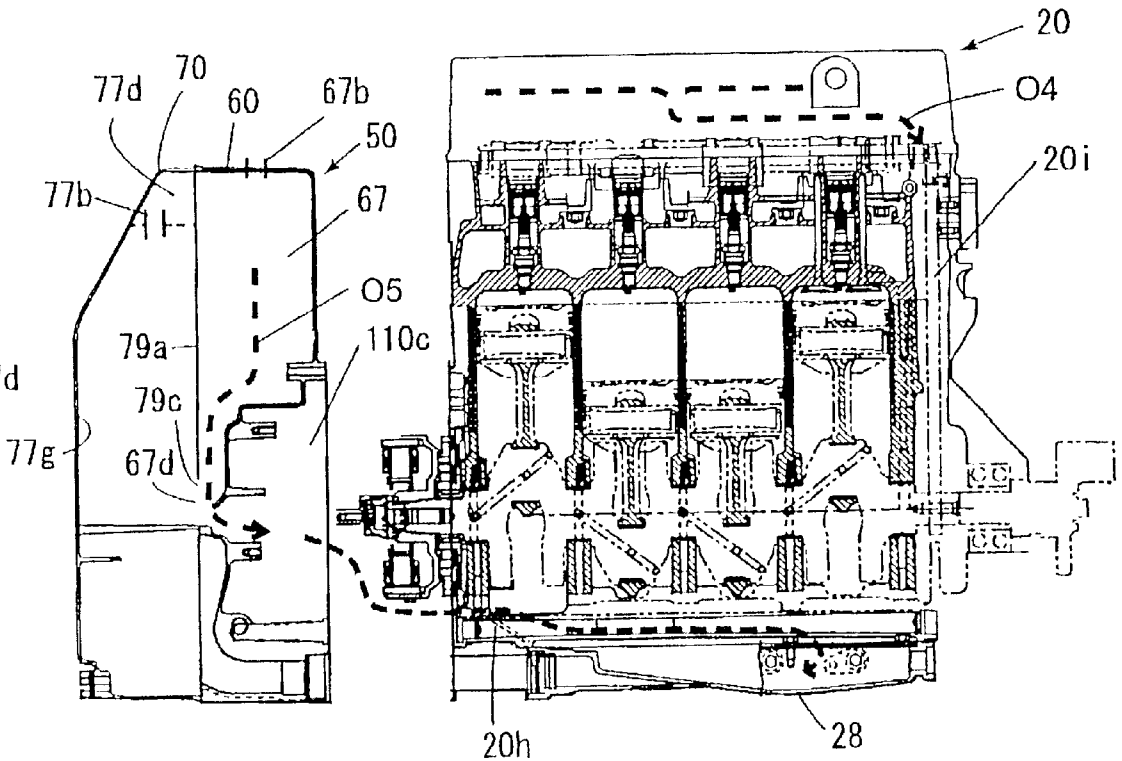
FIG. 20A is a front view and FIG. 20B is its side view.
Figure 20A:
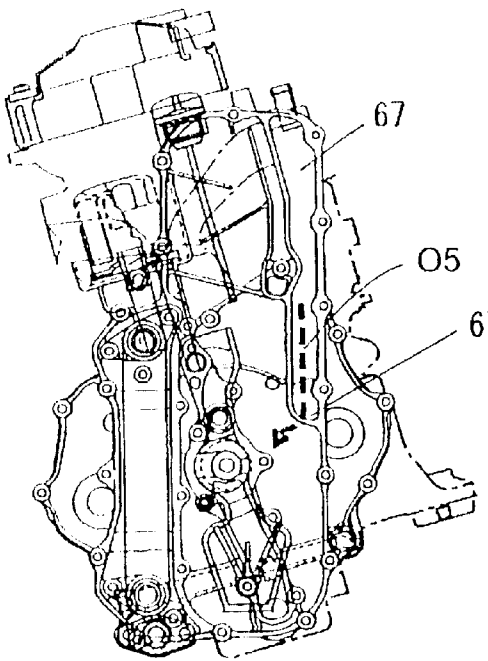

FIGS. 20(*a*) and (*b*) are drawings for explaining the return of oil when the upset boat 10 is restored to its a normal position. FIG. 20(*a*) is a front view, and FIG. 20(*b*) is a side view. For clarity and to simplify the understanding of the flow of oil, in FIG. 20(*b*), the engine 20 and the oil tank 50 are separately.

As shown in FIGS. 20(*a*) and (*b*), when the upset boat 10 is restored to its upright position, oil located in the upper part of the engine 20 (the lower part in the upset state) flows down toward the oil pan 28. Oil located in the main breathing chamber 29(*a*) is returned to the oil pan 28 mainly via the chain chamber 20*i* as shown by an arrow O4 in FIG. 20(*b*).

Oil located in the breather pipe 67*c* is returned to the oil pan 28 via the main breathing chamber 29(*a*), according to a tilted state of the breather pipe 67*c*, or flows into the first deputy breather 67.

As shown by the arrow 05, the oil in the first deputy breather 67 is returned to the oil pan 28 via the return passage 67*d*, the ACG chamber 110(*c*), and the returning passage 20*hi*.

Oil in the oil reservoir 77*d* of the second deputy breather 77 flows down along the inner wall 77*g* of the second deputy breather 77, and is returned to the oil pan 28 via the open part 79*c*, the return passage 67*d*, the ACG chamber 110(*c*), and the returning passage 20*h*. As a result, the boat 10 is restored to a normal condition.

According to the above-mentioned engine for the small-sized planing boat, the following actions and effects are achieved.

(a) Since the engine driving the jet propulsion pump 30, is provided with the upper case 20*m* and the lower case 20*n* divided on the parting face D parallel to the crankshaft 21 and the balancers 114L and 114R are arranged on the left and on the right of the crankshaft 21 on the parting face C), the overall height of the engine 20 can be reduced.

Therefore, the engine is suitable for mounting in the small-sized planing boat 10 having only small space 16 in the body of the boat surrounded by the hull 14 and the deck 15. Also, with this configuration, the center of the gravity of the boat 10 can be lowered.

Also, the crankshaft 21 can be positioned relatively lower, with the result that the balancers 114L and 114R are arranged on the left and on the right of the crankshaft 21 on the parting face D between the upper case 20*m* and the lower case 20*n*. Further, the parting face D, which is parallel to the crankshaft 21 and the shaft 35 of the jet propulsion pump 30, can be coupled on the extended line of the crankshaft 21.

Furthermore, since a space is made available on both sides of the cylinder 20*s* with the result that the balancers 114L and 114R are arranged on the left and on the right of the crankshaft 21 on the parting face D, a degree of freedom of arranging accessories can be achieved.

That is, the engine is suitable for mounting in a small-sized planing boat 10, and simultaneously, the center of the gravity of the boat 10 can also be lowered. In addition, a degree of freedom of arranging accessories is achieved.

In addition, even though the oil pan under the engine is miniaturized, the agitation of oil by the balancers 114L and 114R can be inhibited, as compared with the conventional type engine in which the balancer is provided under the crankshaft. The miniaturized oil pan 28 makes it possible to further reduce the overall height of the engine.

(b) Since the driving gear 113 of the balancer is closely provided at the back of the ACG 110 provided to the end of the crankshaft 21, the driving system of the balancers 114*l* and 114R can be miniaturized, and the overall length of the engine 20 can be reduced.

(c) Since the one-way clutch 124 for starting the engine is provided at the back of the AGC rotor 110 and the balancer driving gear 113 is provided to the periphery of the one-way clutch 124, the overall length of the engine 20 can be reduced by the amount by which the one-way clutch for starting the engine 124 and the balancer driving gear 113 overlap.

(d) Since the oil tank 50 is provided at the front of the engine in the direction of the extended line from the crankshaft 21 and the oil supply passages 60*j* and 60*k* to the balancer supports are formed in the case (the body of the tank in this case) 60 of the oil tank 50, the entire engine 20 can be made smaller, and piping for the oil supply passages to the balancer supports 20L and 20R is not needed.

(e) Since the restrictor 60*m* is provided in the oil supply passages 60*j* and 60*k*, air is easily separated by the restrictor 60*m* even if the air were to be mixed into oil flowing toward the balancer supports 20L and 20R. Therefore, proper lubrication of the balancer shaft is maintained.

(f) Since the oil tank 50 covers the chamber for driving the ACG rotor 110, the balancers 114 (L, R) and the starter motor 120, a separate cover is not required, and the overall length of the engine 20 can be further reduced. In addition, engine noise is reduced by the second absorption effects of the oil in the oil tank 50.

(g) Since the starter motor 120 and the balancers 114L and 114R are arranged in parallel, and the idle gear 116 of one balancer 114R is arranged on the side opposite to the starter motor 120 with the crankshaft 21 between them, the starter motor 120 and the driving system of the balancers can be arranged compactly around the crankshaft. As a result, the center of the gravity of the engine 20 can be lowered, and the center of the gravity of the entire boat 10 can also be lowered.

(h) Since the idle gear 116 of one balancer 114R is arranged on opposite sides of the starter motor 120, with the cylinder 20*s* of the engine between them, the starter motor 120 and the driving system of the balancers can be arranged compactly near the longitudinal axis of the engine. Therefore, the weight of the engine, the starter motor 120, and the driving system can be centralized near the center of the body of the boat 11, and the turning performance of the boat 10 can be enhanced.

(i) Since the oil tank 50 is provided in the direction of the extended line from the crankshaft 21 of the engine 20 and the oil pump 80 driven by the crankshaft 21 is provided to the oil tank 50, the piping structure of oil can be simplified. Further, since the relief valve 130 for controlling the discharge pressure of the oil pump 80 is provided in the oil tank 50, relief oil from the relief valve 130 is discharged into the oil tank 50.

Therefore, the capacity of the oil pump 80 can be reduced, compared with conventional configurations in which an oil pump in which relief oil is discharged into the engine 20 (for example, into the oil pan).

Since the relief valve 130 provided for communicating with the discharge passage 55 of the oil pump 80 is housed in the oil tank 50 and touches the cover 70, the relief valve 130 can be easily housed and repaired. Also, since the body of the tank 60 and the cover 70 are bonded via the substantially perpendicular joining surfaces 62 and 71, and the relief valve 130 is housed horizontally, the relief valve 130 can be easily attached.

(k) Since the oil pump 80 is housed on the side of the body of the tank 60 of the oil tank 50, and the intake/discharge passages 51, 53, 50*a* and 60*b* of the oil pump 80 are integrated with the body of the tank 60, the piping structure of Oil can be simplified.

Also, since the oil filter is provided in the upper part of the oil tank 50, and the connecting passages 60*a*, 60*b*, 60*e* and 60*f* the oil tank 50 and the oil filter 100 are formed in the oil tank 50, the piping structure of oil can be further simplified.

(l) Since the oil filter 100 is opposite to the opening is a of the deck 15, it can be replaced more easily.

(m) Since deputy breathers 67, 77 are provided in the oil tank 50 independently of the engine 20, and the breathers (67, 77) and the engine 20 communicate with each other, a breather is not necessarily required in the head cover 29 of the engine 20. Also, even if the breather is provided, the capacity can be remarkably reduced. In this embodiment, even though a main breathing chamber 29(i a) is provided in the head cover 29 of the engine 20, the capacity is reduced markedly.

Therefore, the overall height of the engine 20 can be reduced, and the engine 20 can be easily housed in the small-sized body of the boat 11.

Therefore, a small-sized boat 10 can be provided which does not make much noise and which is low in emissions.

(n) Since the oil tank 50 is formed by bonding the divided cases 60 and 70, and the breathers 67 and 77 are formed by bonding the divided cases 60 and 70, the capacity and the shape of the breather can be freely set.

(o) Since the inlet 67*b* for breathing gas to the breather (67, 77) is formed in the upper part of the oil tank 50, the outlet 77*b* for breathing gals is formed below the inlet 67*b* and the return passage 67*d* for returning oil separated in the breather (67, 77) is formed in the oil tank of 50 (the body of the tank 60 in this embodiment), gas can more effectively be separated from the oil, and the separated oil can be easily returned.

Further, since the divided cases 60 and 70 are bonded via the gasket 79, and the breather (67, 77) is partitioned by the gasket 79, the gas-liquid separation can be accomplished more effectively.

(p) Since the pulser 118 for taking a signal is provided on the periphery of ACG and overlaps the oil tank 50 in a direction of the crankshaft 21, the shaft need not be extended for the pulser 118. As a result, the more compact engine can be provided.

(q) Since the housings 64 and 74 of the water-cooled oil cooler 90 are integrated the oil tank 50, the piping of oil and the piping of cooling water can be simplified.

(r) Since the oil filter 100 is provided to the oil tank 50 and the oil cooler 90 is insert into the oil path from the oil filter 100 to the main gallery 20*a* of the engine 20, the coolest oil can be supplied to the main gallery 20*a* of the engine 20. Therefore, the engine 20 can be efficiently cooled. Also, since cooling water from the cooling water outlet 30*a* in the jet pump 30 is first supplied to the housing 74 of the water-cooled oil cooler 90, oil housed in the oil tank 50 as well as the oil cooler 90 can,be efficiently cooled.

(s) Since the engine 20 is mounted in the small-sized boat and the breather 67 forms the oil reservoir when the boat is upset, the outflow of oil can be prevented.

Also, as the engine 20 is mounted in the small-sized boat and the return passage 67*d* forms the breathing passage when the boat is upset, the outflow of oil can be securely prevented. Further, since the oil reservoir 77*d* in which oil flows in a reverse direction in the return passage 67*d* when the boat is upset is provided in the upper part (the lower part in upset) the second breather 77, the outflow of oil can be more securely prevented.

Since the oil reservoir of the oil tank 50 has a length longer than the width, the amount of air introduced into the oil when the boat 10 rolls from side-to-side is reduced. Further, since multiple baffles 65*a* and 75*a* are provided in the oil reservoir, the amount of air into introduced into oil introduced into the oil when the boat 10 pitches fore and aft run is also reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine for a planing boat mounted in the boat surrounded by a hull and a deck for driving a jet propulsion pump, comprising:

an upper case and a lower case respectively divided on a parting face parallel to a crankshaft;

a balancer arranged on the left and on the right of the crankshaft on the parting face, a direction of rotation of the balancer on the right side of the crankshaft being reverse of a direction rotation of the balancer on the left side of the crankshaft; and an oil tank covering a chamber for driving an ACG rotor, the balancers, and a starter motor.

2. The engine for a planing boat according to claim 1, further comprising a driving gear for driving the balancer provided in close contact with the back of the ACG rotor, the ACG rotor being provided on an end of the crankshaft.

3. The engine for a planing boat according to claim 2, further comprising a one-way clutch for starting the engine provided at the back of the ACG rotor, the balancer driving gear being provided on the periphery of the one-way clutch.

4. The engine for a planing boat according to claim 1, further comprising:

the oil tank provided at the front of the engine on a line extending from the crankshaft; and an oil supply passage for supplying oil to a balancer support formed in a case of the oil tank.

5. The engine for a planing boat according to claim 4, further comprising a restrictor provided in the oil supply passage.

6. The engine for a planing boat according to claim 1, wherein:

a starter motor of the engine and the balancer are arranged in parallel; and an idle gear of one balancer is arranged on the side opposite to the starter motor, with a cylinder of the engine between them.

7. The engine for a planing boat according to claim 1, wherein:

a starter motor of the engine and the balancer are arranged in parallel; and an idle gear of one balancer is arranged on the side opposite to the starter motor, with the crankshaft between them.

8. An engine for a planing boat mounted in the boat surrounded by a hull and a deck for driving a jet propulsion pump, comprising:

an upper case and a lower case respectively divided on a parting face parallel to a crankshaft;

a balancer arranged on the left and on the right of the crankshaft on the parting face;

a starter motor of the engine being arranged in parallel to the balancer; and an idle gear provided on one of either the balancer on the right side or the balancer on the left side, the idle gear being arranged on the side opposite to the starter motor, with a cylinder of the engine between them.

9. The engine for a planing boat according to claim 8, further comprising a driving gear for driving the balancer provided in close contact with the back of an ACG rotor, the ACG rotor being provided on an end of the crankshaft.

10. The engine for a planing boat according to claim 9, further comprising a one-way clutch for starting the engine provided at the back of the ACG rotor, the balancer driving gear being provided on the periphery of the one-way clutch.

11. The engine for a planing boat according to claim 8, further comprising:

an oil tank provided at the front of the engine on a line extending from the crankshaft; and an oil supply passage for supplying oil to balancer support formed in a case of the oil tank.

12. The engine for a planing boat according to claim 11, further comprising a restrictor provided to the oil supply passage.

13. The engine for a planing boat according to claim 12, wherein the oil tank covers a chamber for driving the ACG rotor, the balancer and the starter motor.

14. The engine for a planing boat according to claim 8, wherein:

the starter motor of the engine and the balancer are arranged in parallel; and the idle gear provided on the balancer on the side opposite to the starter motor, with the crankshaft between them.

* * * * *